US005802434A

United States Patent [19]

Takehara et al.

[11] Patent Number: 5,802,434

[45] Date of Patent: Sep. 1, 1998

[54] IMAGE FIXING APPARATUS WITH SEPARATION MEMBER

[75] Inventors: Yoshifumi Takehara; Masaaki Sakurai, both of Yokohama, Japan

[73] Assignee: Canon Kabushiki Kaisha, Tokyo, Japan

[21] Appl. No.: 217,134

[22] Filed: Mar. 24, 1994

Related U.S. Application Data

[63] Continuation of Ser. No. 921,616, Aug. 3, 1992, abandoned, which is a continuation of Ser. No. 307,507, Feb. 8, 1989, abandoned.

[30] Foreign Application Priority Data

| | | | |
|---|---|---|---|
| Feb. 9, 1988 | [JP] | Japan | 63-026648 |
| May 16, 1988 | [JP] | Japan | 63-118811 |
| May 16, 1988 | [JP] | Japan | 63-118812 |
| May 16, 1988 | [JP] | Japan | 63-118813 |
| May 16, 1988 | [JP] | Japan | 63-118822 |
| May 17, 1988 | [JP] | Japan | 63-118295 |
| May 17, 1988 | [JP] | Japan | 63-118296 |

[51] Int. Cl.[6] ..... G03G 15/20; G03G 21/00

[52] U.S. Cl. ..... 399/323; 271/308

[58] Field of Search ..... 355/225, 315; 271/307, 308, 310, 900; 399/322, 323

[56] References Cited

U.S. PATENT DOCUMENTS

| | | | |
|---|---|---|---|
| 4,062,534 | 12/1977 | Sasahara | 432/60 X |
| 4,065,120 | 12/1977 | Imaizumi et al. | 271/900 X |
| 4,252,310 | 2/1981 | Kono et al. | 271/308 |
| 4,408,757 | 10/1983 | Yarm | 271/900 X |
| 4,443,101 | 4/1984 | Sakurai et al. | 271/307 X |
| 4,804,576 | 2/1989 | Kuge et al. | 428/216 |
| 4,893,146 | 1/1990 | Tachibana et al. | 271/308 X |
| 4,951,936 | 8/1990 | Taniyama | 271/307 |

FOREIGN PATENT DOCUMENTS

| | | | |
|---|---|---|---|
| 3606662 | 4/1986 | Germany . | |
| 57-44170 | 3/1982 | Japan | 355/282 |
| 58-224368 | 12/1983 | Japan | 355/290 |
| 1-17081 | 1/1989 | Japan | 355/282 |

OTHER PUBLICATIONS

Slucha, Thomas, "Movable Pressure Roll Fingers", Mar./Apr. 1980, vol. 5, No. 2, pp. 217 and 218 Xerox Disclosure Journal.

*Primary Examiner*—Fred L. Braun

*Attorney, Agent, or Firm*—Fitzpatrick, Cella, Harper & Scinto

[57] ABSTRACT

An image fixing apparatus which includes a rotatable member for fixing an image, a plurality of separation members for contacting the rotatable member, and a mechanism for shifting the contactable member in a direction of a generating line of the rotatable member so as to engage and disengage the separation members from the rotatable member. The shifting of the separation members is timed so that they are separated from the rotatable member a line period shorter than that required for fused toner on the separation member to solidify.

32 Claims, 15 Drawing Sheets

IMAGE FIXING APPARATUS WITH SEPARATION MEMBER

This application is a continuation of application Ser. No. 07/921,616, filed Aug. 3, 1992, now abandoned, which was a continuation of application Ser. No. 07/307,507, filed Feb. 8, 1989, now abandoned.

FIELD OF THE INVENTION AND RELATED ART

The present invention relates to an image fixing apparatus usable with an image forming apparatus such as a laser beam printer and copying machines, more particularly to an image fixing apparatus including a rotatable image fixing member and a member contactable to the rotatable member such as a separation pawl and a thermister.

In conventional image fixing device which is usable with an image forming apparatus such as an electrophotographic apparatus, a pair of rotatable members, more particularly a pair of rollers is widely used. In such an image fixing apparatus using a pair of rollers, after the toner image is fixed on an image bearing member such as a sheet of paper or the like, the image bearing member sometimes sticks to the roller and is wrapped therearound. In order to prevent this, a separation member or members are provided in contact with the roller. The roller (or rollers) has a surface layer made of a heat-resistive rubber, such as silicone rubber, fluorine rubber and fluorosilicone rubber or tetrafluoroethylene, material in the form of a coating in order to reduce toner offset which is a phenomena wherein the toner is deposited on the roller surface during the image fixing operation.

In order to increase the sheet separation effect, it is preferable that the contact pressure between the roller and the separating member is increased. However, if the separation member is contacted to the roller surface with such a high pressure for a long period of time, the surface of the roller is damaged by the toner deposited on the separation member, because the contact therebetween is always at the same position or positions and because the surface of the roller is not so hard.

For the purpose of solving this problem, Japanese Laid-Open Utility Model Application 39237/1978 discloses that the separation member is displaced in the direction of the length of the roller with the separation member contacted to the roller, thus changing the contact position or positions to reduce the contact period at the same position.

However, this proposed method involves the following problems:

(1) The longitudinal movement of the separation member is effected with the toner existing at the contact portion between the roller and the separation member, and therefore, the roller surface is sometimes damaged in the longitudinal direction;

(2) During longitudinal movement, the separation member is inclined by the amount of play of a shaft on which the separation member is mounted, and therefore, an edge or sharp corner of the separation member is urged to the roller, so that the roller surface is easily damaged;

(3) Due to the inclined contact of the separation member described in paragraph (2), the sheet is not sufficiently separated from the roller, with the result that a jam may occur; and (4) Since the separation member is at all times in contact with the surface of the roller, the deposition of the offset toner on the separation member is not reduced.

The damage to the surface of the roller by the separation member is most remarkable, but another element such as a temperature sensing element (thermister or the like) involves the same problem. In U.S. Pat. No. 4,043,747, the thermister is shifted in the longitudinal direction of the roller, but as will be understood from the foregoing description, the same problems as with the Japanese Laid-Open Utility Model Application 39273/1978 are involved.

SUMMARY OF THE INVENTION

Accordingly, it is a principal object of the present invention to provide an image fixing apparatus wherein the damage to the surface of an image fixing rotatable member is remarkably reduced.

It is another object of the present invention to provide an image fixing apparatus wherein a plurality of separation members are integrally and uniformly shifted.

It is a further object of the present invention to provide an image fixing apparatus wherein the separation member can be moved without adverse affect to the function of separating the image bearing member from the rotatable image fixing member.

It is a further object of the present invention to provide an image fixing apparatus wherein the surface of the image fixing rotatable member is not damaged by a solidified toner during movement of the separation member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
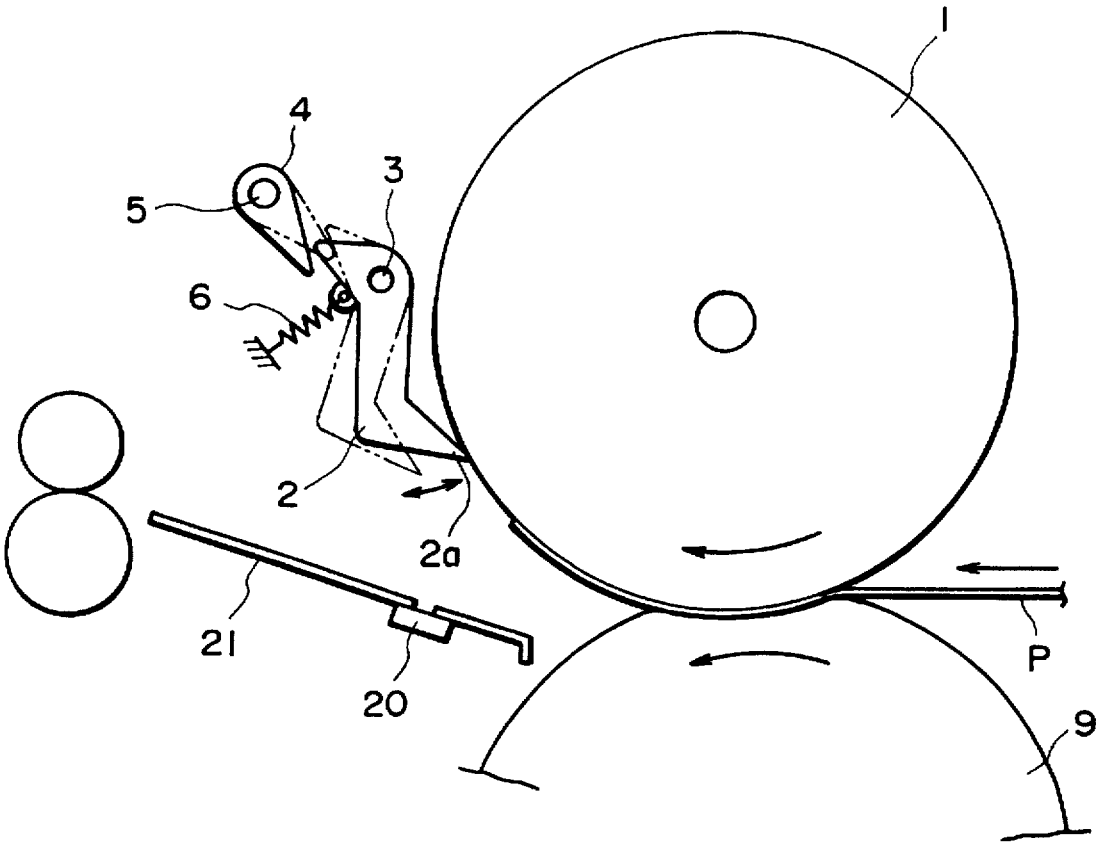
FIG. 1 is a side view of an image fixing apparatus according to an embodiment of the present invention.

The preferred embodiments of the present invention will be described in conjunction with the accompanying drawings wherein like reference numerals are assigned to the elements having corresponding functions.

Figure 2:
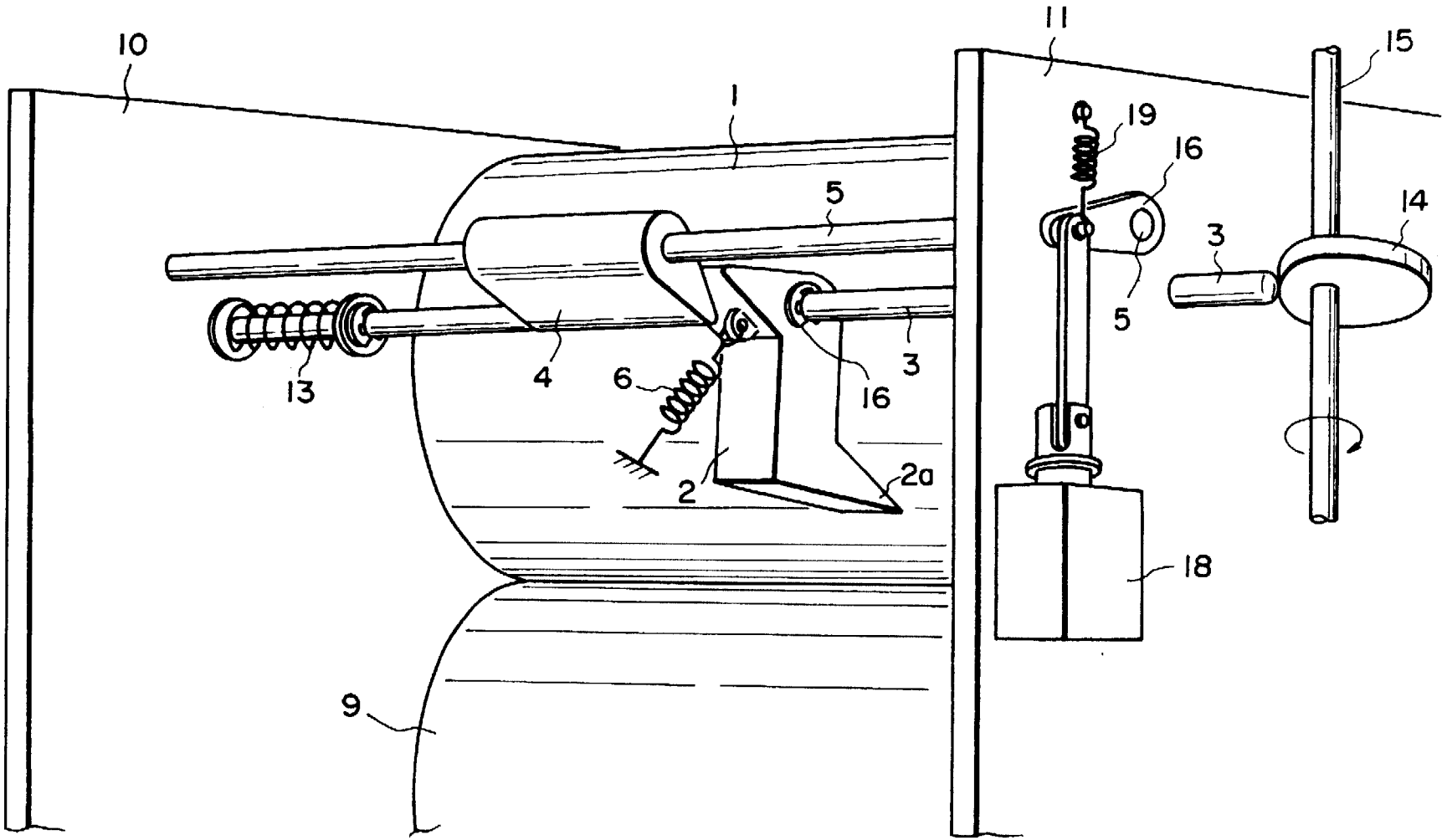
FIG. 2 is a perspective view of the image fixing apparatus of FIG. 1.

Referring to FIG. 1, there is shown an image fixing apparatus according to an embodiment of the present invention. FIG. 2 is an enlarged sectional view illustrating a moving mechanism for a separation pawl.

As shown in FIG. 1, the image fixing apparatus includes an image fixing roller 1 containing a heating means and rotatable in a direction indicated by an arrow by an unshown driving means and a back-up or pressing roller 9 below the fixing roller 1, which is press-contacted to the fixing roller 1 and which follows the rotation of the fixing roller 1.

An image carrying member for carrying an unfixed toner image is passed through a nip formed between the image fixing roller 1 and the pressing roller 9, whereby the image is fixed on the image carrying member.

The fixing roller 1 has a surface layer made of fluorine resin exhibiting good parting property. The pressing roller 9 has a silicone rubber layer, and, if necessary, a very thin fluorine resin coating layer on the silicone rubber layer.

To the surface of the fixing roller 1, an edge 2*a* of a separation pawl 2 functioning as the separation or wrapping prevention member is resiliently contacted. The separation pawl 2 is rotatably mounted on a shaft 3 extending parallel to the axis of the fixing roller 1. The separation pawl 2 is confined in its longitudinal position relative to the shaft 3 by a stopper 16. The resilient contact described above is provided by a torque exerted by a tension spring 6 at a rear side of the separation pawl 2. The separation pawl 2 is made of heat-resistive material such as P.P.S polyamideimide, polyimide or the like or a relatively soft metal for the purpose of assuring smooth sliding and strength without damage to the surface of the fixing roller 1. The edge thereof has a triangular cross section having a sharp edge and expanding rearwardly. The shaft 3, as shown in FIG. 2, is supported by side plates 10 and 11 of the fixing roller apparatus for sliding movement in the longitudinal direction of the shaft 3, and is always urged in one direction by a spring 13 mounted to the left-hand side plate 10 (toward right in FIG. 2). It is contacted to an eccentric cam 14 fixedly mounted to the shaft 15 which is rotationally driven, at an outside of the right-hand side plate 11.

In an opposite side of the shaft 3 from the image fixing roller 1, there is a shaft 5 parallel with the shaft 3. Opposite ends of the shaft 5 are rotalably supported in the side plates 10 and 11 of the image fixing apparatus, similarly to the shaft 3. However, it is not movable in its longitudinal direction. The shaft 5 is provided with a flapper 4 for urging upwardly the rear portion of the separation pawl 2 by its edge portion by rotation of the shaft 5. The width of the flapper 4 measured in the direction of the length of the shaft 5 is such that it can sufficiently urge the separation pawl 2 irrespective of the position of the slidable separation pawl.

To an end of the shaft 5 outside the side plate 11, an end of a lever 16 for rotating the shaft 5 is mounted. The other end of the lever 16 is connected with a tension spring 19 which is in turn connected with a solenoid 18 at its other end. When the solenoid 18 is energized, the lever 16 is pulled toward the solenoid 18 against the tension force by the spring 19, by which the lever 16 is rotated. The flapper 4 is not contacted to the rear portion of the separation pawl 2 when the solenoid is not energized so that only the tension force of the spring 19 is applied to the lever 16. When, on the other hand, the solenoid 18 is energized to rotate the lever 16 toward the solenoid 18, it urges the rear portion of the separation pawl 2.

The image fixing apparatus according to this embodiment is provided with a sensor 20 mounted on a conveyance guiding member 21 disposed downstream of the image fixing apparatus with respect to conveyance direction of the image carrying sheet to detect passage of the sheet, and with a control means (not shown), which permits energization of the solenoid 18 for a predetermined period of time in response to a signal produced by the sensor 20; permits energization of an unshown rotational driving means for the cam shaft 15, and shuts off energization of the solenoid 18 and the rotational driving means after a predetermined period of time passes.

Operation of a separation pawl of the image fixing apparatus of this embodiment will be described. When the image carrying member P carrying the unfixed toner image enters the nip of the pair of rollers, only a tension spring 6 acts on the rear portion of the separation pawl 2, and therefore, the leading portion 2*a* of the separation pawl 2 is resiliently contacted to the surface of the fixing roller 1. The image carrying material is pressed and conveyed by the nip between the fixing roller 1 and the pressing roller 9, and if the leading edge thereof is attached to the fixing roller 1, the separation pawl 2 functions to separate it from the surface of the fixing roller 1. Thereafter, the sensor 20 detects the leading edge of the carrying member, and a signal produced thereby is supplied to the control means (not shown).

The control means supplied with this signal energizes the solenoid 18, by which the plunger of the solenoid 18 pulls the lever 16 downwardly against the spring 19 to rotate the shaft 5. Then, the flapper 5 urges the rear portion of the separation pawl 2 upwardly to separate the leading edge 2*a* of the separation pawl from the surface of the fixing roller 1. The control means permits energization of a rotational driving means (not shown) for the cam shaft 15 after a predetermined period of time passes to shift the separation pawl 2 in the longitudinal direction of the shaft 3 through a predetermined distance without contact with the fixing roller 1, by way of the shaft 3 contacted to the eccentric cam 14. Thereafter, the control means stops the energization of the rotational driving means for the cam shaft 15 and the solenoid 18, so that the separation pawl 2 is again brought into contact with the fixing roller 1 at the shifted position, to be prepared for separation of the next sheet if it is wrapped around the fixing roller.

As will be understood from the foregoing, the separation pawl is separated from the fixing roller and is again contacted thereto in association with movement of the separation pawl in the direction of the generating line of the fixing roller, and therefore, the problems arising during movement of the separation pawl in the direction of the generating line of the fixing roller, such as the inclined contact and the score in the generating line direction, are solved.

Further, in this embodiment, the start of the movement of the separation pawl in the direction of the generating line is effected after the separation pawl is separated from the fixing roller, and therefore, there is no problem at the start of the movement in that direction.

In addition, the contact between the separation pawl and the fixing roller is effected after stoppage of the separation pawl in that direction, there is no problem at the time of the stoppage of the movement of the separation pawl.

In this embodiment, two driving means are required because separate driving means are provided for the sliding movement of the shaft 3, which serves as a supporting member, and the rotational movement of the shaft 5, respectively. However, it is possible that one driving means is used for the sliding movement of the shaft 3 and for the rotational movement of the shaft 5.

Another embodiment wherein the single driving means is used will be described. In the foregoing embodiment, an eccentric cam 14 is used for the sliding movement of the shaft 3. However, in the present embodiment, a swash plate or the like which is a sort of a three dimensional cam is used. A rotational axis of the swash plate is disposed parallel with the shaft 3, and an inclined surface of the swash plate is contacted with one end of the shaft 3 to accomplish sliding movement of the shaft 3. Since, on the other hand, a lever 16 for rotating the flapper 4 similar to that of the above-described embodiment is mounted to the shaft 5, the rotational shaft of the swash plate can be rotated by the plunger or the solenoid, by fixedly mounting on the swash plate cam shaft a lever similar to the lever 16 fixed to the rotational shaft 5 and by disposing the solenoid such that it can rotate the two levers simultaneously. At this time, the plunger of the solenoid makes sliding movement within a predetermined range, and therefore, the swash plate also rotates within a predetermined range. Therefore, the lever of the swash plate is provided with a one way clutch so that the driving force is transmitted to the swash plate only when the plunger of the solenoid moves in a predetermined direction. If the whole of the plunger for rotatably connecting with an engagement projection of the lever of the shaft of the swash plate is an elongated hole, it is possible to delay the rotation of the lever of the swash plate shaft relative to the rotation of the lever 16. By this, similarly to the foregoing embodiment, the shifting movement of the separation pawl 2 in the longitudinal direction of the shaft 3 starts, through the shaft 3 in contact with the swash plate, after a certain period after separation of the separation pawl 2 from the surface of the fixing roller 1 by rotation of the lever 16. Flapper 4, shaft 5, tension spring 6, lever 16, solenoid 18 and tension spring 18 together may serve as disengaging and engaging means.

Figure 3:
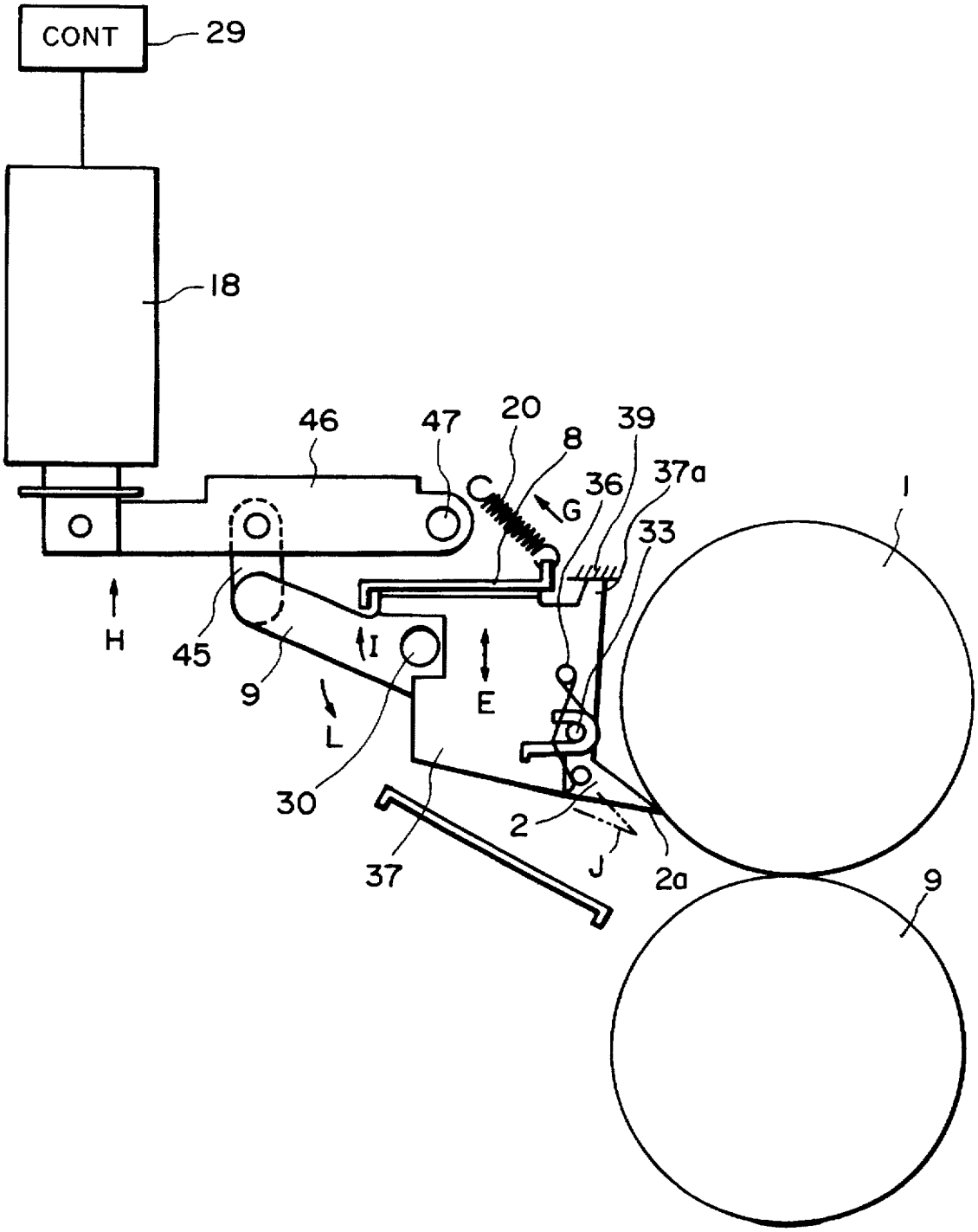
FIG. 3 is a side view of an image fixing apparatus according to another embodiment of the present invention.
Figure 4:
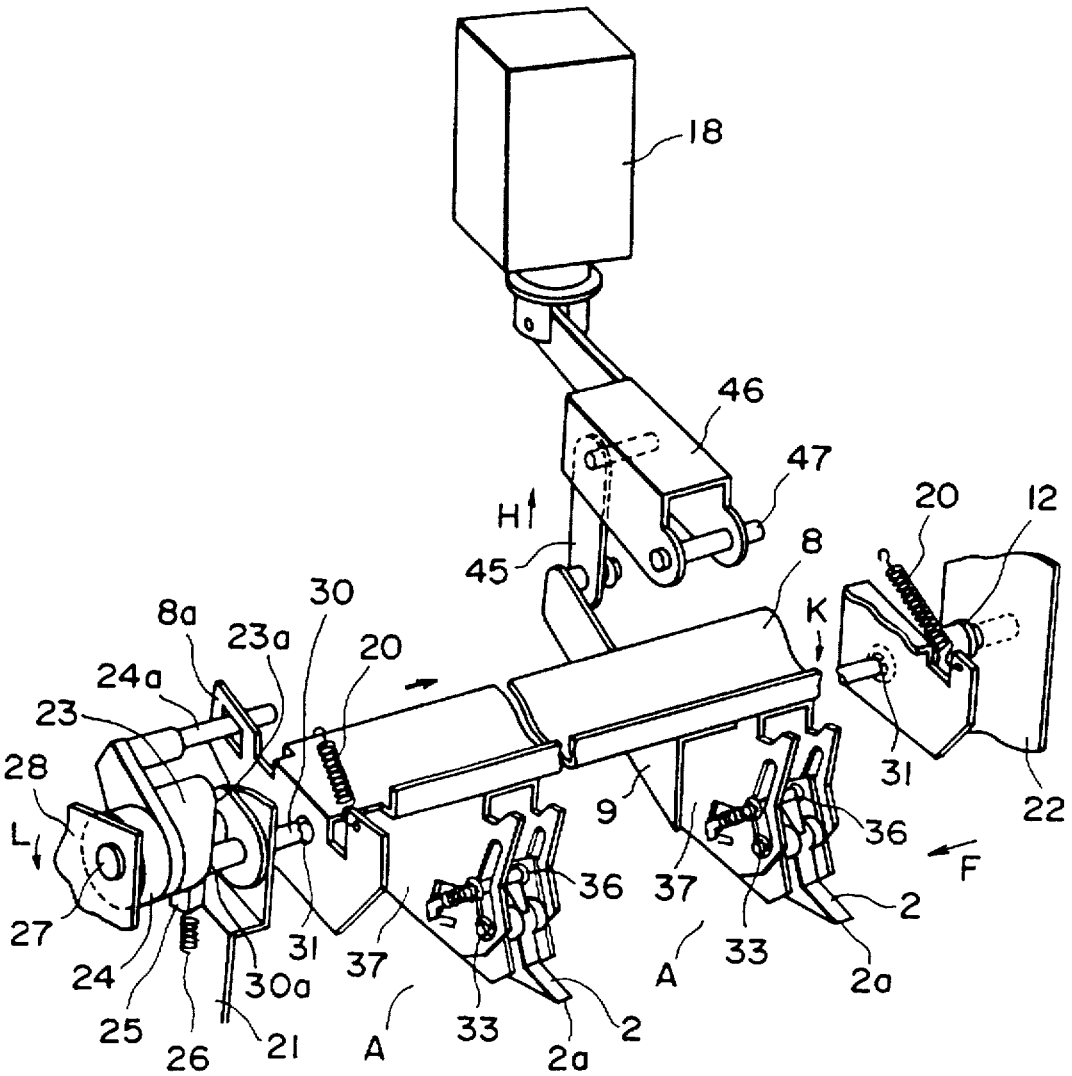
FIG. 4 is a perspective view of a moving mechanism for the separation member used in FIG. 3 embodiment.

Referring to FIGS. 3 and 4, an image fixing apparatus according to a further embodiment of the present invention will be described.

FIG. 3 is a side view, and FIG. 4 is a perspective view, of the image fixing apparatus according to this embodiment. In this embodiment, the fixing roller 1 is provided with a surface layer made of fluorine resin, and an inside elastic layer. To the surface of the fixing roller 2, an edge 2*a* of a separation pawl 2 functioning as a separation or wrapping prevention member rotatably mounted to a shaft 33 extending parallel with the shaft of the fixing roller 1. The resilient contact is provided by a torque given by a coil spring 36. The separation pawl 2 is made of heat-resistive material such as P.P.S polyamideimide. Polyimide or a relatively soft metal in order to assure smooth sliding movement and strength without damage to the fixing roller 1. The surface thereof may be coated with tetrafluoroethylene resin or the like, and the edge thereof has a triangular cross section expanding toward rearwardly and having an acute edge. The separation pawl 2 and the shaft 33 providing the rotational center of the separation pawl 2 is supported on a supporting member 37.

FIG. 4 shows only two separation members A constituted by the separation pawls and the separation pawl supporting members is shown. However, the number of the separation members A may properly be determined by one of ordinary skill in the art, so as to meet, for example, all of A6–A3 and B6–B4 sizes of the sheets.

The plural separation members A are fixedly mounted to a separation member fixing plate 8, and the fixing plate 8 has an arm 9 mounted thereon. The fixing plate 8 is rotatable in a direction E about a center of a shaft 30 rotatably supported on the side plates 21 and 22. As regards the longitudinal direction, the opposite ends thereof are mounted to the rotational shaft 30 by thrust member 31, and is normally urged in the direction F by a compression coil spring 12. The arm 9 is connected to an arm 46 through a linkage 45. The arm 46 is rotatable about a center of the rotation of the shaft 47, and the other end is connected with a solenoid 18. With this structure, the separation member A is normally urged in a direction G by the tension spring 20, and a positioning portion 47*a* is abutted to the positioning portion 39 of the fixing apparatus or the like and is positioned there. In this state, the edge 2*a* of the separation pawl is contacted to the surface of the fixing roller 1.

An end 30*a* of the shaft 30 is formed into a spherical shape R and is contacted to an inclined surface 23*a* of the cam 23 by the spring force of the spring 12. To the cam 23, a braking member urged by the spring 26 is press-contacted. A shaft 27 fixed to the cam 23 is rotatably supported on the side plates 28 and 21 and rotates together with the cam. With the rotational shaft 27, a lever 24 including a one way clutch is engaged, and the leading edge 24*a* of the lever is coupled with an opening 8*a* formed in the fixing plate 8.

The operation of this embodiment will be described. As described hereinbefore, the separation pawl 2, as shown in FIG. 3, is normally such that the positioning portion 37*a* of the pawl supporting member 37 is abutted to the positioning portion 39 of the fixing apparatus or the like by the spring force provided by the spring 20 and is maintained there, and that the edge 2*a* of the pawl is contacted to the roller.

When a separation signal for the separation pawl is produced in a control means 29, the solenoid 18 is energized so that the arm 46 is pulled in the direction H, and therefore, the arm 46 rotates about the center 47. Together with this, the fixing plate 8 rotates in the direction I about the center of the shaft 30 through the linkage 45 and the arm 9, so that the pawl 2 engaged with the pawl supporting member 47 is moved, whereby the edge 2*a* moves to the position indicated by a reference 1A, thus separating from the surface of the roller. The following operations are also performed simultaneously.

By engagement between the opening 8*a* and the edge portion 24*a* of the lever 24 together with movement of the fixing plate 8 in the direction indicated by an arrow K, the lever 24 rotates in the direction K about a center of the rotational shaft 27. As described hereinbefore, the lever 24 is integral with a one way clutch, and therefore, the above movement moves the rotational shaft 27 in the direction K since the direction K is a locking direction of the clutch, whereby the cam 23 integral with the shaft also rotates in the same direction.

Figure 5:
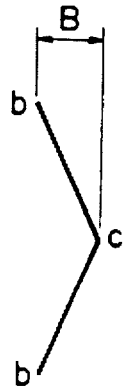
FIG. 5 is a developed view of a cam surface of FIG. 4 embodiment.

This moves the rotational shaft 30 in the direction I by being guided by the cam surface. FIG. 5 shows a developed cam surface, and the cam surface starts with the bottom portion b, and includes a high position c which is connected to the bottom portion b. The cam surface is a circular surface, and the maximum moving width is B as indicated.

By the above-described movements, the separation of the edge 2*a* of the pawl from the roller surface and the longitudinal movement thereof are simultaneously performed.

When a signal for contacting the edge of the pawl to the roller is produced in the control means 29, the solenoid 18 is deenergized, so that the pawl is again contacted to the roller. The lever 24 is rotated in the opposite direction L. Since the lever 24 includes the one way clutch which has an idle rotation direction L, the shaft 27 does not rotate due to the action of the brake 25 to the cam 23 integral with the shaft 27. Therefore, with this operation, the pawl is not shifted in the longitudinal direction, and only the operation for bringing the pawl into contact with the roller surface is performed.

According to this embodiment, the engaging and disengaging of the pawl relative to the roller and the longitudinal movement thereof can be accomplished with a simple structure.

Since the plural separation members provided corresponding to various sizes of usable sheets are reciprocated in the direction of generating line of the roller and are engaged with and disengaged from the roller surface by movement of the fixing plate for fixing the plural pawls, the space or spaces between adjacent separation members measured along the generating line of the roller are maintained constant, and in addition, the timing of the engagement and disengagement of the separating pawls is the same for all the separating pawls, thus preventing occurrence of sheet jam.

In this embodiment, the movement of the separation member is preferably performed at the following time or times.

When the main image forming apparatus is supplied with, power, the fixing roller is heated by a heater, not shown. When the temperature of the roller reaches a predetermined level, the rotor starts to rotate and is prepared for performing its function. The disengagement, longitudinal movement and engagement of the pawls are performed when the predetermined temperature is reached or when a temperature which is close to the predetermined temperature and which is above a toner fusing temperature is reached. Then, the separation pawl can be moved without danger of the occurrence of the jam or the like. It is possible that during the period not requiring for the pawl to be in contact with the roller surface such as during the pre-rotation or post-rotation of the photosensitive member of the image bearing member, the pawls are kept spaced apart from the roller surface. However, since the offset toner is deposited on the edge of the pawls, the toner is solidified when the roller is cold, and therefore, it is preferable from the standpoint of the damage to the roller that the pawl is moved when a certain level of the temperature is reached, that the toner is fused.

The same advantages can be provided by moving the pawls during the stand-by operation after completion of the copying operation.

Further, in such an image fixing apparatus without the heating means as in a pressure-fixing type image fixing apparatus, the roller temperature is not important, and therefore, the shifting may be carried out during a certain time within post- or pre-rotation period.

Figure 6:
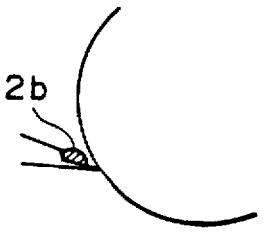
FIG. 6 is a side view of another separation pawl.

By the disengagement and engagement operation of the separation pawl relative to the roller, the following advantages can be provided. As described hereinbefore, since the separation pawl is contacted to the surface of the roller, the edge 2*a* of the pawl is contaminated by fused offset toner, as shown in FIG. 6 in consideration of this, an accumulation portion 2*b* is formed at the edge of the pawl to accumulate the toner, thus preventing jam occurrence attributable to the pawl edge being separated from the roller surface due to the toner. According to this embodiment, by plural disengagement and engagement actions, the contact period between the edge of the pawl and the roller can be reduced. Therefore, the durability on the roller can be improved, and the wear of the edges of the pawls can be reduced, and in addition, amount of toner fused thereto can be reduced. Thus, the reduction of the jam occurrence at the separation pawls is accomplished.

In this embodiment, the plural pawls are simultaneously disengaged from the roller surface and are moved. However, similarly to FIGS. 1 and 2, separate driving sources (solenoids or motors or the like) may be used for the disengaging means and the reciprocating means for reciprocating along the length of the roller. In this case, the drive timing may be such that the longitudinal movement is effected during the disengaging period, or during the longitudinal movement, it is disengaged.

However, by performing the longitudinal movements of the plural separating members and disengagement and engagement operations by the same driving source, the movement of the separation members while being in contact with the roller can be assuredly prevented, and therefore, it is preferable.

Figure 7:
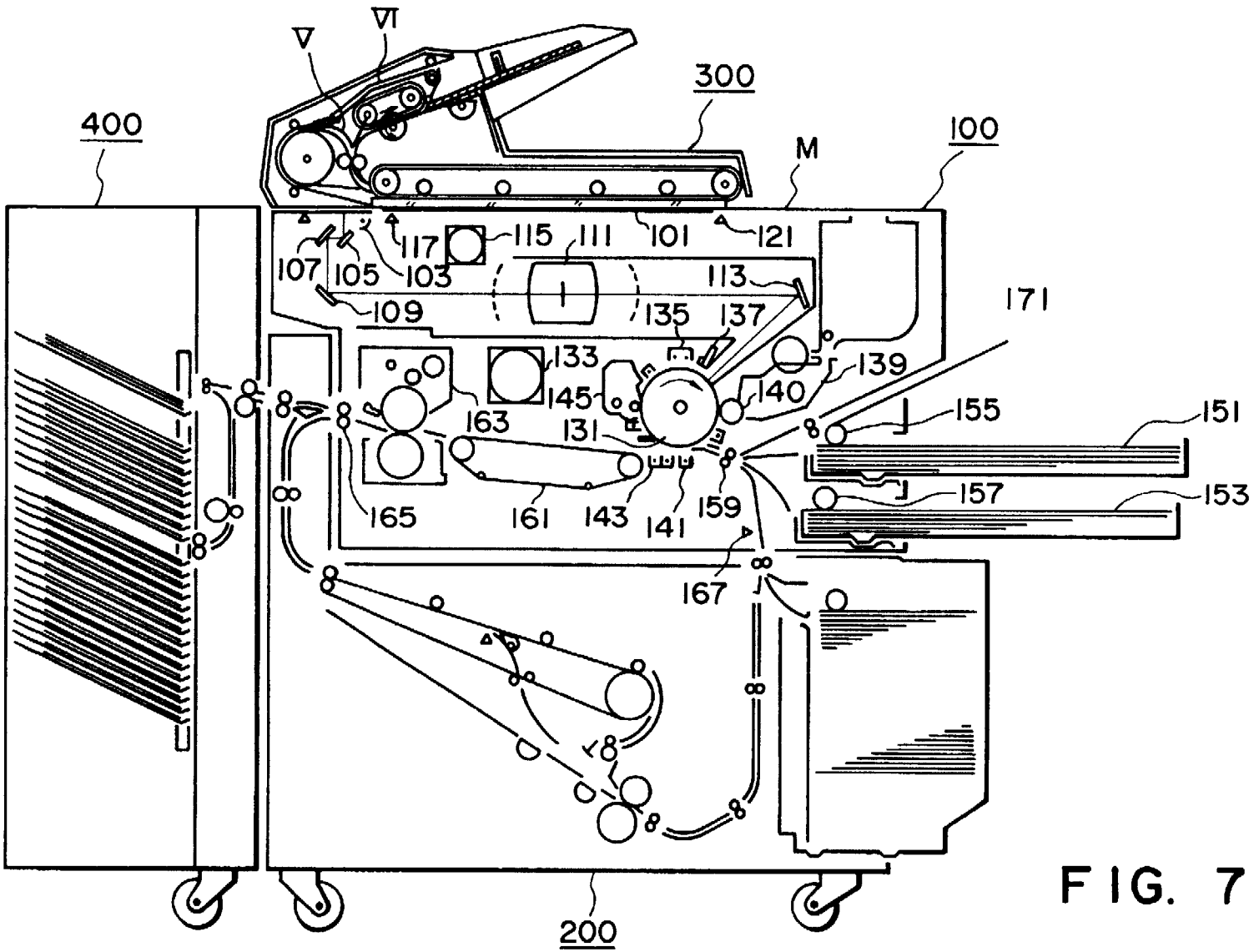
FIG. 7 is a sectional view of an image forming apparatus usable with the image fixing apparatus according to the present invention.

Referring to FIG. 7, a further embodiment of the present invention will be described. FIG. 7 is a sectional view of an image forming apparatus according to the embodiment of the present invention. In FIG. 7, a copying apparatus is shown as an exemplary image forming apparatus, wherein a reference numeral 100 designates the main assembly of the copying apparatus.

The copying apparatus includes a pedestal 200 having a function of duplex copy wherein the recording medium (sheet) is inverted in its facing orientation or a function of superimposing copy wherein plural image forming operations are effected on one and the same recording medium, a circulation type document feeder 300 for automatically feeding original documents, and a sorter for sorting the copy sheets into plural bins. Those units 200, 300, and 400 can be selectively combined with the main assembly 100. The main assembly 100 includes a platen glass 101 for supporting an original document to be copied, an illumination lamp (exposure lamp) for illuminating the original on the platen glass 101, scanning reflection mirrors (scanning mirrors) 105, 107 and 109 for deflecting the light reflected by the original, a lens 111 for focusing at variable magnification the image of the original, a force reflection mirror (scanning mirror) 113, a motor 115 for driving the optical system, and sensors 117, 119 and 121.

The main assembly 100 further includes a photosensitive drum 131, a main motor 133 for driving the photosensitive drum 111, a high voltage unit 135, a blank exposure unit 137, a developing device 139, a developing roller 140, a transfer charger 141, a separation charger 143 and a cleaning device 145.

The main apparatus further includes an upper cassette 151, a lower cassette 153, a manual sheet feeder 171, sheet feeding rollers 155 and 157, a registration roller 159. A conveying belt 161 is provided to convey the recorded sheet to the fixing apparatus. A fixing apparatus 163 fixes the image on the sheet by heat and pressure. A sensor 167 is used for duplex recording.

The surface of the photosensitive drum 131 is a seamless photosensitive layer including a photoconductor and a conductor. The photosensitive drum 131 is rotatably supported and is rotated by a main motor 133 responsive to depression of a copy starting button which will be described hereinafter, in the direction indicated by an arrow. After the start of the rotation, the photosensitive drum 131 is subjected to a pre-rotation during which the potential of the photosensitive member is controlled (pre-process). Then, the original placed on an original supporting platen glass 101 is illuminated by an illumination lamp 103 which is integral with the first scanning mirror 105, and the light reflected by the original is imaged on the drum 131 by way of the second scanning mirror 107, the third scanning mirror 109, the lens 111 and the force scanning mirror 113.

The drum 113 is charged by a corona charger supplied from a high voltage unit 135. Thereafter, the image of the original illuminated by the illumination lamp 103 is slit-exposed, so that an electrostatic latent image is formed on the drum 131 by a known Carlson process.

Then, the electrostatic latent image on the photosensitive drum 131 is developed by the developing roller 140 of the developing device 139 into a visualized toner image, and the toner image is transferred onto a transfer sheet by a transfer charger 141, which will be described hereinafter.

The transfer sheet in the upper cassette 151, the lower cassette 153 or in the manual feed port 171 is supplied into the main apparatus by the pick-up roller 155 or the pick-up roller 157, and then, it is conveyed to the photosensitive drum 131 by the registration roller 159 at such correct timing that the leading edge of the latent image and the leading edge of the transfer sheet are aligned. Thereafter, by passage of the transfer sheet between the transfer charger 141 and the drum 131, the toner image is transferred from the photosensitive drum 131 to the transfer sheet. After the completion of the image transfer, the transfer sheet is separated from the drum 131 by a separation charger 143, and is introduced into the fixing apparatus 163 by the conveying belt 161, and then, the image thereon is fixed by pressure and heat. Subsequently, the sheet is discharged outside the main apparatus 100 by the discharging roller 165.

The drum 131, after the image transfer, continued to rotate, and is cleaned at its surface by the cleaning device 145 constituted by a cleaning roller and an elastic blade.

Figure 8:
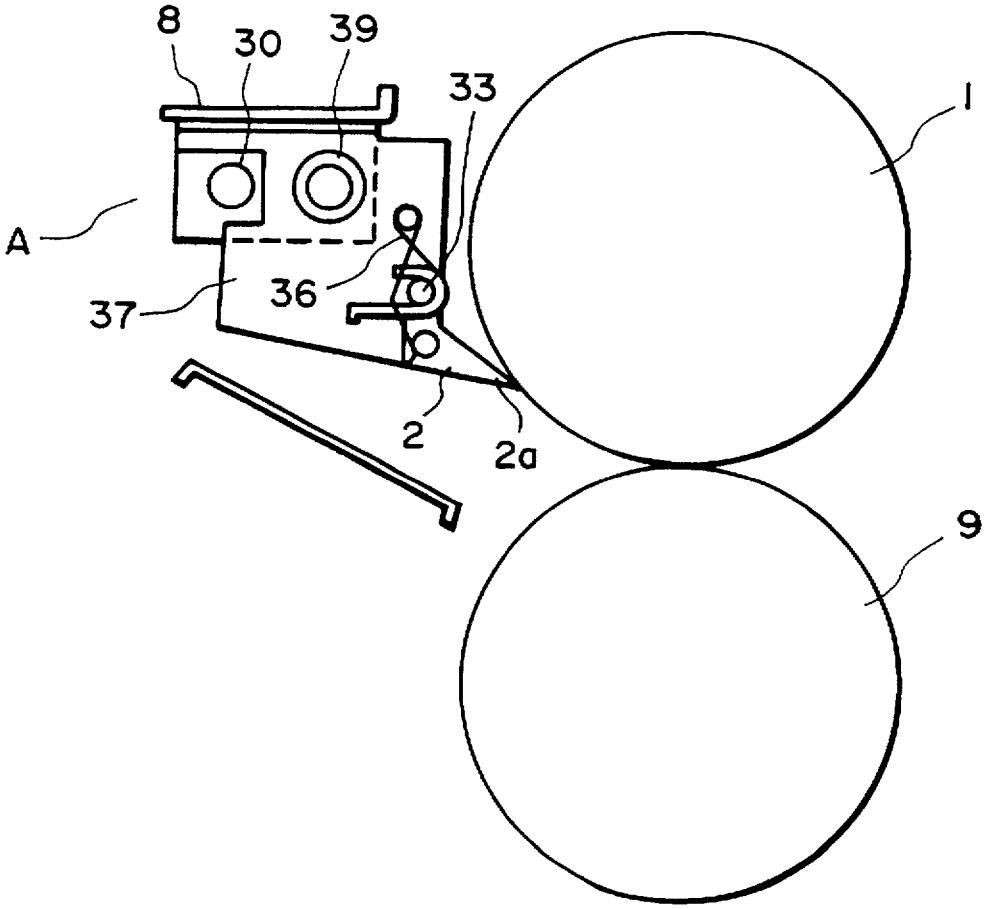
FIG. 8 is a side view of an image fixing apparatus according to a further embodiment of the present invention.
Figure 9:
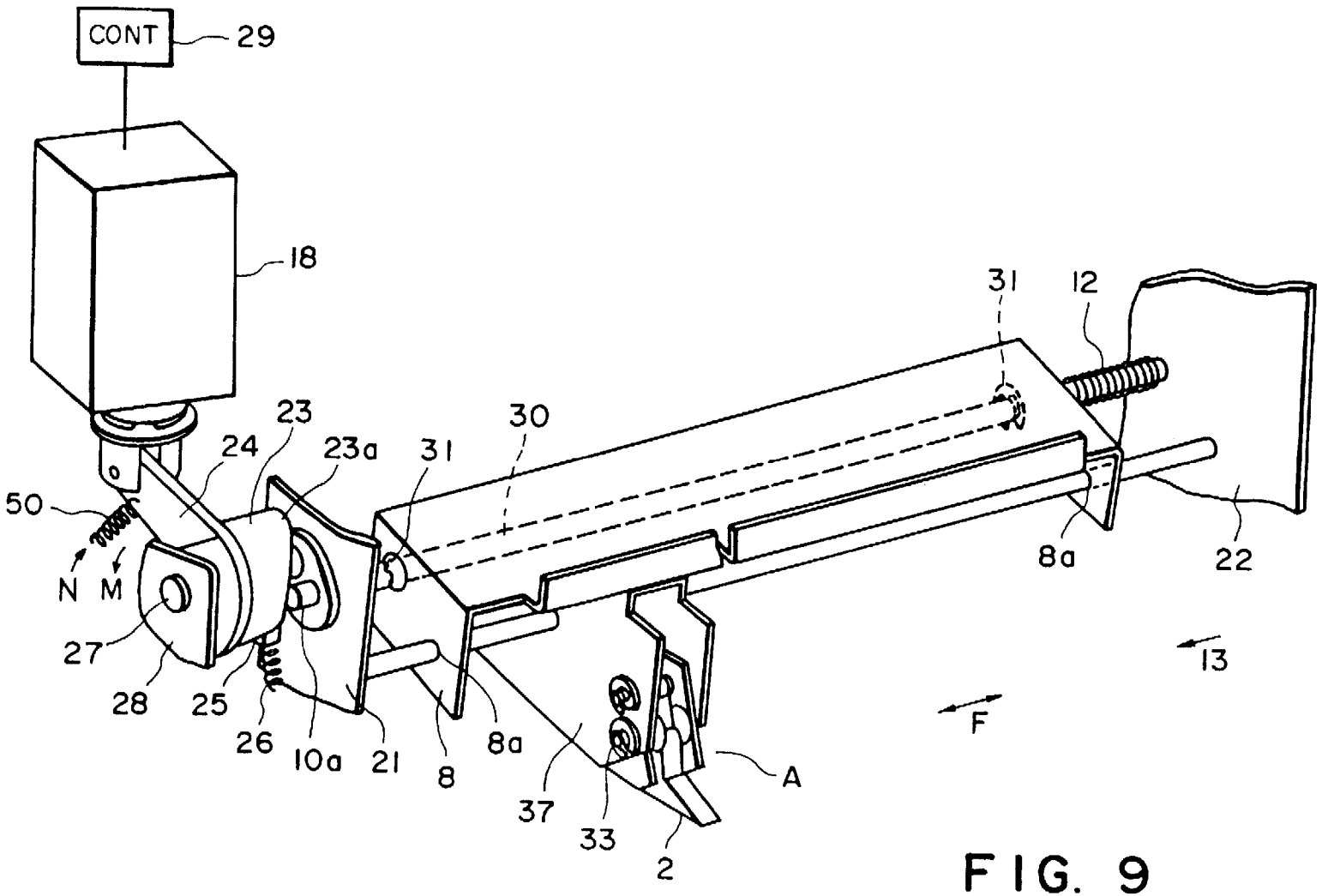
FIG. 9 is a perspective view of a moving mechanism for a separation member according to FIG. 8 embodiment.

Referring to FIGS. 8 and 9, a mechanism for movement of the separation pawl will be described. FIG. 8 is a side view of an image fixing apparatus, and FIG. 9 is a perspective view illustrating a mechanism for moving the separation pawl.

From various experiences and experiments, the damage of the image fixing roller is different, even if the total number of the processed sheets are the same, between when the sheets are intermittently processed by respective printing instructions (intermittent mode) and when the fixing roller is continued to be rotated in response to plural sheet copy instructions (continuous mode). The service life of the roller in the intermittent mode is approximately one third that in the continuous mode.

This means that even if the separation pawl is kept contacted at the same position of the roller, the service life is approximately three times the intermittent mode, if the apparatus is operated in the continuous mode.

Next, when an instruction signal for shifting the separation pawl by the control means 29 under certain condition, the solenoid 18 is energized to rotate the lever 24 about the center of the shaft 27 in the direction 33.

In FIG. 9, only one separating member A constituted by the separation pawl and the separation pawl supporting member is shown, but the number of the separation members A may be determined, as shown in FIG. 4, properly to meet, for example, all of A6–A3 and B6–B4 sizes of the sheets.

The separation member A is securedly fixed on the separation member fixing plate 8, and the fixing plate 8 is supported by a shaft 39 fixed to the side plates 21 and 22 and a shaft 30 which is slidable in the longitudinal direction. The fixing plate 8 is longitudinally slidable by the sliding engagement between the shaft 39 and the hole 38*a*. Since the shaft 30 is integral with the fixing plate 8 through the one-way clutch having a locking direction N, the rotational shaft 27 rotates in the direction of arrow N, and the cam 23 integral with the shaft rotates in the same direction. The rotational shaft 30 is forced by the cam surface to move in the direction F. The cam surface may be the same as shown in FIG. 5, wherein the cam surface starts from the bottom portion b continued to the top portion c and further continued to the bottom portion b in a circumference. The cam surface provides the maximum movable width B.

With the foregoing movements, the edge 2*a* of the pawl moves in the longitudinal direction of the roller surface.

When a movement instruction signal for the pawl is produced by the control means 29, the solenoid 18 is deenergized, so that the spring 50 rotates the lever 24 in the opposite direction M. As described hereinbefore, the lever 24 is associated with the one-way clutch having an idle rotation direction M, and therefore, the shaft 27 integral with the cam 27 confined by the brake 25 does not rotate, and stops at the position.

Figure 10:
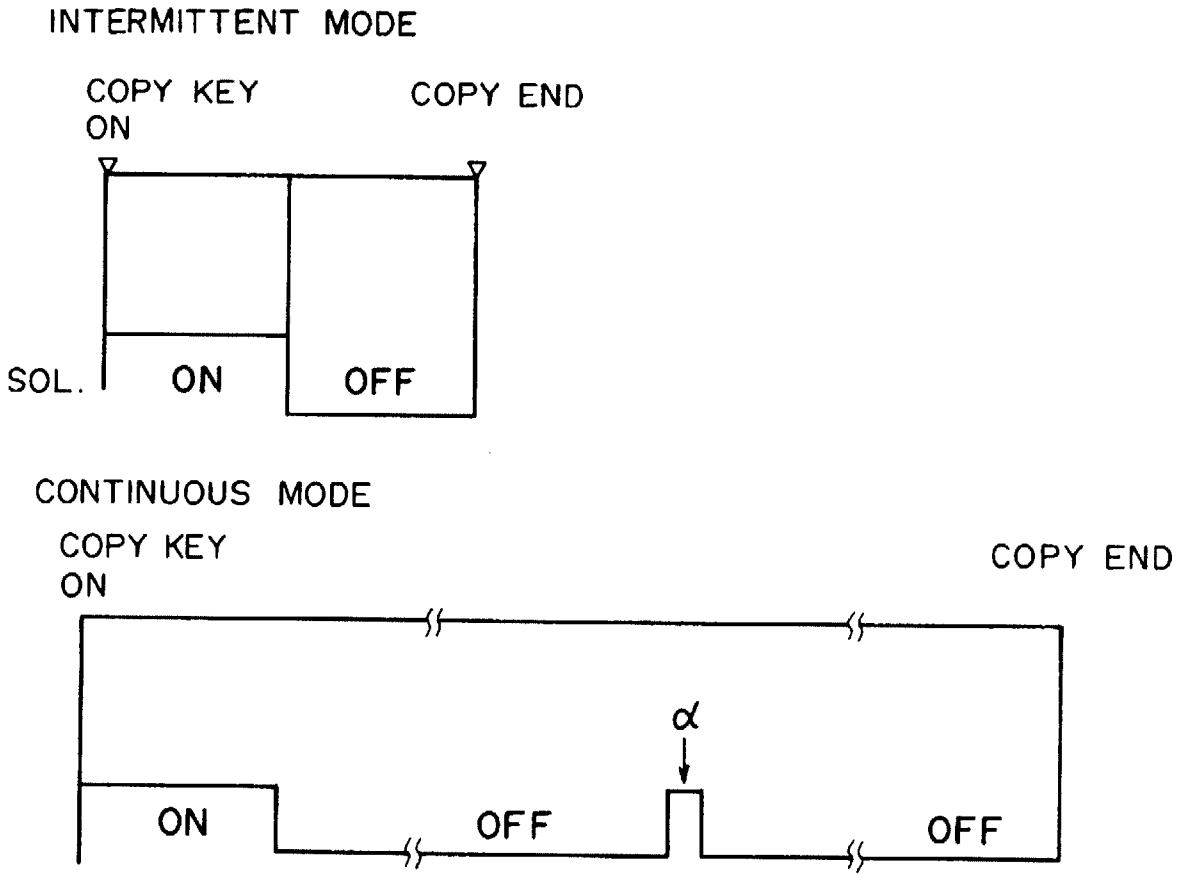
FIG. 10 is a timing chart illustrating movement of the separation pawl according to a further embodiment of the present invention.

FIG. 10 shows an example of the timing for energization and deenergization of the solenoid, that is, the timing of the movement of the separation member during the intermittent mode and the continuous mode.

When one copy mode is executed, the movement is always performed because this mode more easily damages the roller, as described hereinbefore.

When the continuous mode is executed, one movement of the separation pawl is performed once after a predetermined number of the copies are taken, for example for each of 20 sheet operations, for example, more particularly between the 20th sheet and 21st sheet. From the standpoint of the durability of the moving mechanism of the solenoid and the pawl, the number of operations is preferably small. Also, from the standpoint of the risk of the jam occurrence in consideration of the movement effected during the sheets, the number of movements is preferably small.

As shown in FIG. 10, the separation member is moved every predetermined number of sheets processed for image fixation, wherein the predetermined number is selected in accordance with the roller wear which is different depending on the modes, whereby the number of movements of the separation member can be reduced. Also, the durability of the movement mechanism can be solved, and simultaneously therewith, occurrence of jam can be prevented.

As shown in FIG. 9, when a solenoid is used for the movement mechanism, continuous energization of the solenoid results in temperature rise thereof up above approximately 100° C., with the possible result of damage of the solenoid. When the fixing apparatus uses a heated roller, this tendency is particularly remarkable, and therefore, the reduction of the number of separation member movements is very significant.

The operation modes to be considered include any modes resulting in difference in the degree of the roller wear.

Figure 11:
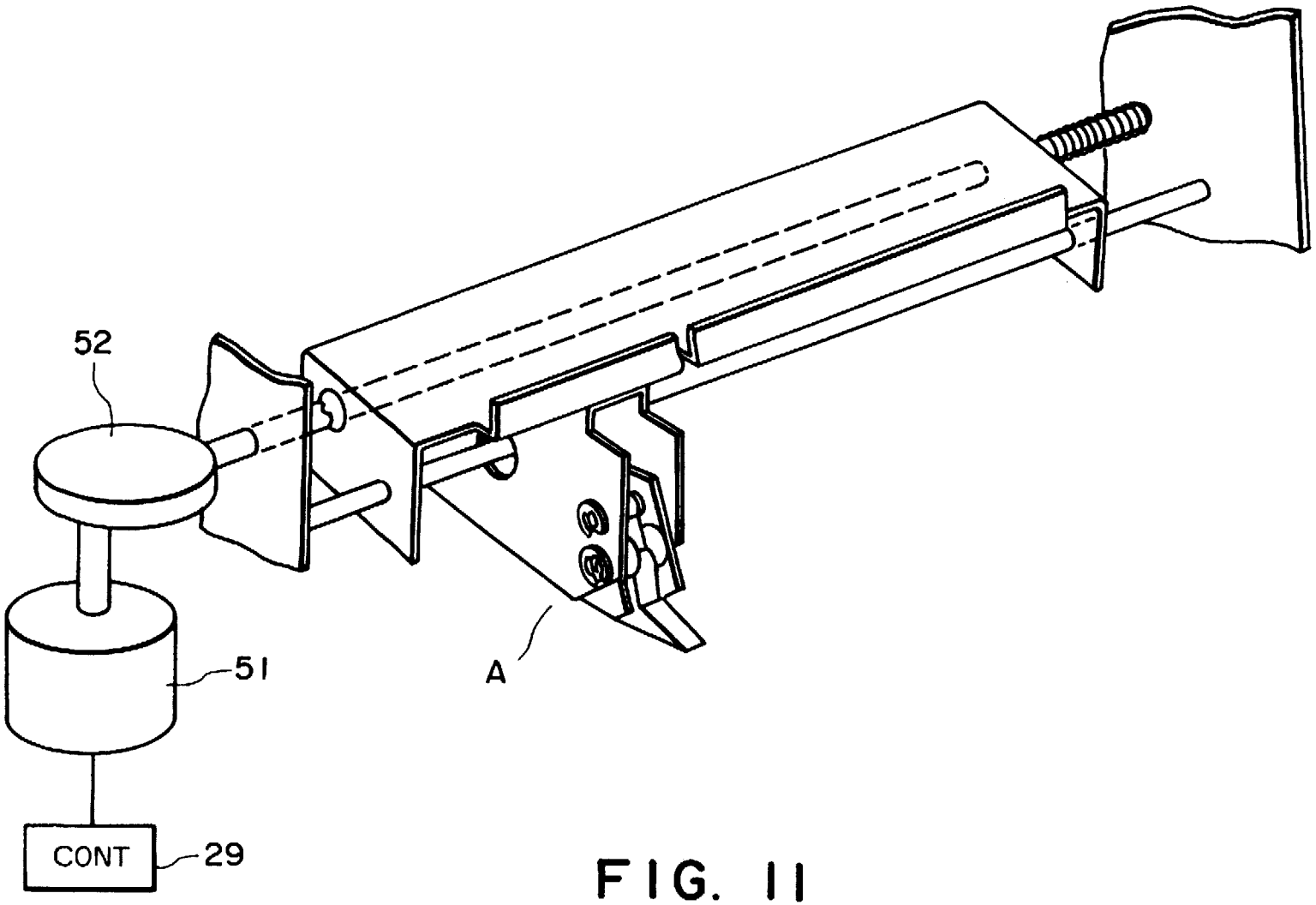
FIG. 11 is a perspective view of a moving mechanism for the separation member according to a further embodiment of the present invention.

FIG. 11 shows another example of the separation member movement mechanism, wherein the reciprocable movement, that is, the movement in the longitudinal direction is provided by the stepping motor or the like 51 and the cam 52. In this method, the amount of the reciprocal movement of the separation member can be controlled by the number of rotations of the motor 51.

More particularly, a rotation angle of the cam for one movement of the separation pawl is such that if 360 is not an integer multiple of the rotational angle, the separation pawl is not positioned at the same plates. Alternatively, the same effect can be prevented if the least common multiple of the angles for the cam motions is not lower than 360 degrees.

In this embodiment, the separation member is moved in the direction of the generating line of the roller.

Figure 12:
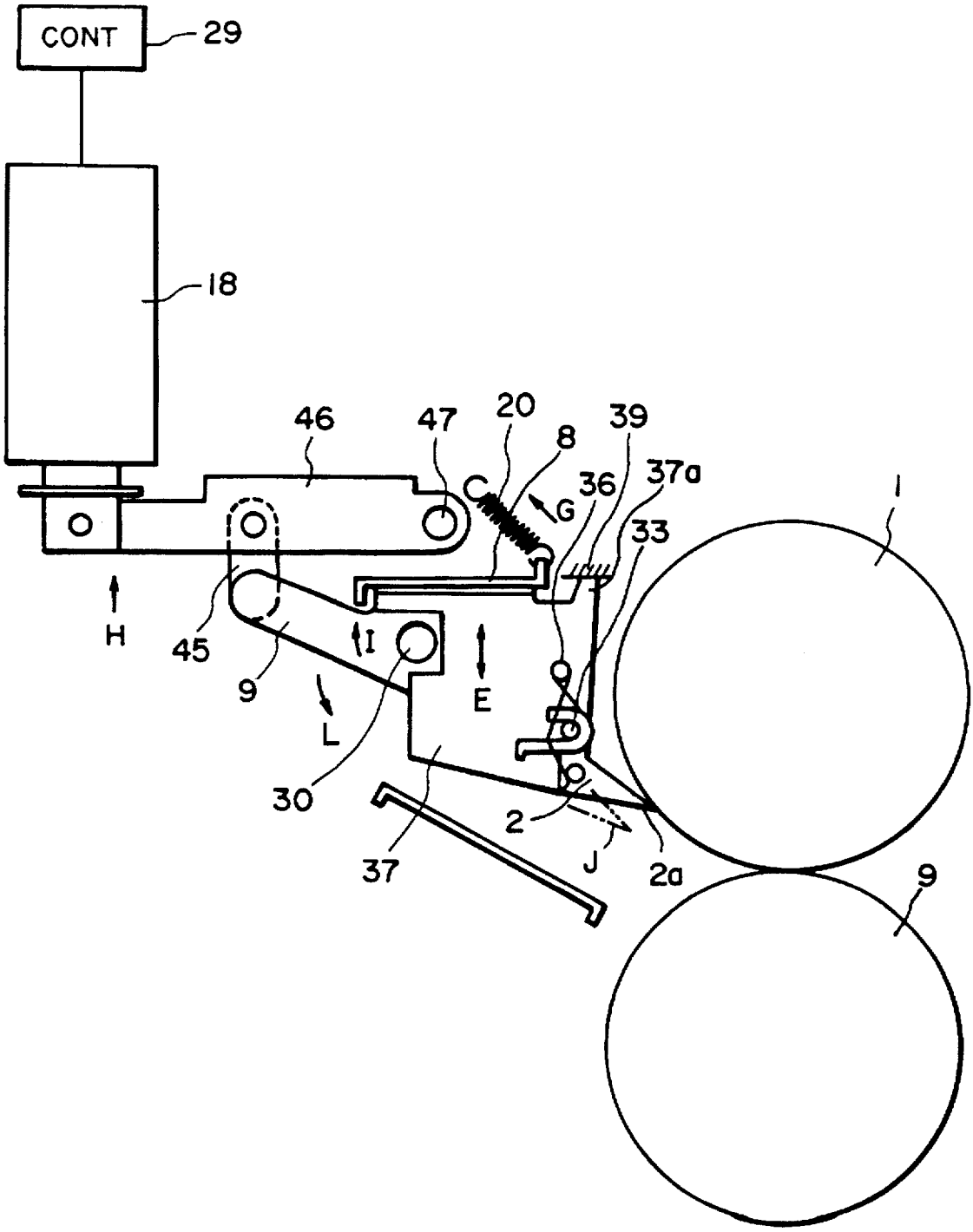
FIG. 12 is a side view of an image fixing apparatus according to a further embodiment of the present invention.
Figure 13:
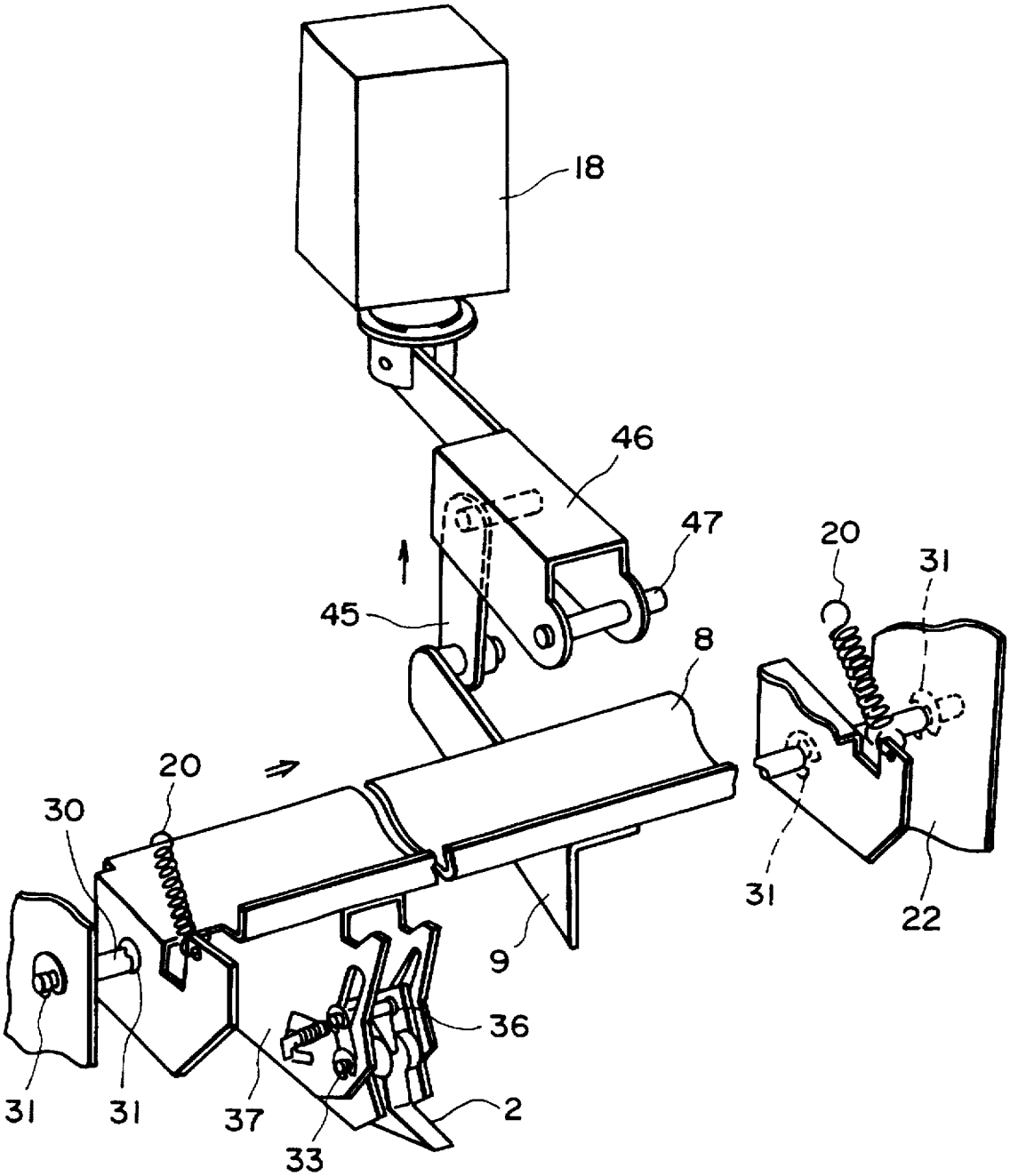
FIG. 13 is a perspective view of a mechanism for moving the separation member in FIG. 12 embodiment.

Referring to FIGS. 12 and 13, another embodiment wherein the separation member is engaged to and disengaged from the roller will be described. The timing of the engagement and disengagement may be as shown in FIG. 10. FIG. 12 is a side view of this embodiment, and FIG. 13 is a perspective view of FIG. 12 embodiment. An arm 9 is mounted on the separation member fixing plate 8 and is rotatable in the direction E about a center of the shaft 30 rotatably supported on the side plates 21 and 22. It is mounted on the shaft 30 by a thrust stop member 11 at its opposite ends. The arm 9 is coupled with an arm 46 through a link 45, and the arm 46 is rotatable about the center of the shaft 47 and is connected with the solenoid 18 at the other end. The pawl supporting member 37 is urged in the direction G by a tension spring 20, and a positioning portion 37*a* is abutted to the positioning portion 19 of the fixing apparatus or the like and positioned there. With this state, the edge 2*a* of the pawl is contacted to the surface of the fixing roller 1.

The operation of the apparatus in this embodiment will be described. Normally, the separation pawl 2, as shown in FIG. 6, is such that the positioning portion 37*a* of the pawl supporting member 37 is abutted to and positioned at the positioning portion 39 of the fixing apparatus by the spring force 20, and the edge 2*a* of the pawl is in contact with the roller. When a separation signal for the separating pawl is supplied from the control means 29, the solenoid 18 is energized, by which the arm 46 is rotated in the direction H, and rotates about the center 47. Together with this, the pawl supporting member fixing plate 8 and the pawl supporting member 37 are rotated through the link 45 and the arm 9 about a center of the shaft 30, and the pawl 2 mounted to the pawl supporting member 7 moves, and therefore, the edge 2*a* of the pawl is moved to the position indicated by the reference J and is separated from the surface of the roller.

Next, when a signal for contacting the edge of the pawl to the roller is produced, the solenoid 18 is deenergized, so that the edge is brought into contact with the roller.

By the engaging and disengaging of the separation pawl to the roller, the wear of the roller can be reduced, but some wear which is more or less unavoidable occurs at the same position, and therefore, it is preferable that the separation pawl is shifted in the direction of the axis of the roller to make the degree of the wear more uniform.

The function of changing the number of shifts of the separation member or members depending on the image formation mode, shown in FIG. 10, is applicable the embodiments shown in FIGS. 1 and 2, and FIGS. 3 and 4.

As for the count of the number of fixing operations in the embodiments, the number of the sheets reaching the front or rear part of the fixing roller may be counted, or the number of image forming operations which substantially corresponds to the number of image forming process operations, may be counted.

In the embodiment shown in FIG. 10, the roller temperature is also preferably not less than the toner fusing temperature when the separation member is moved.

Figure 19:
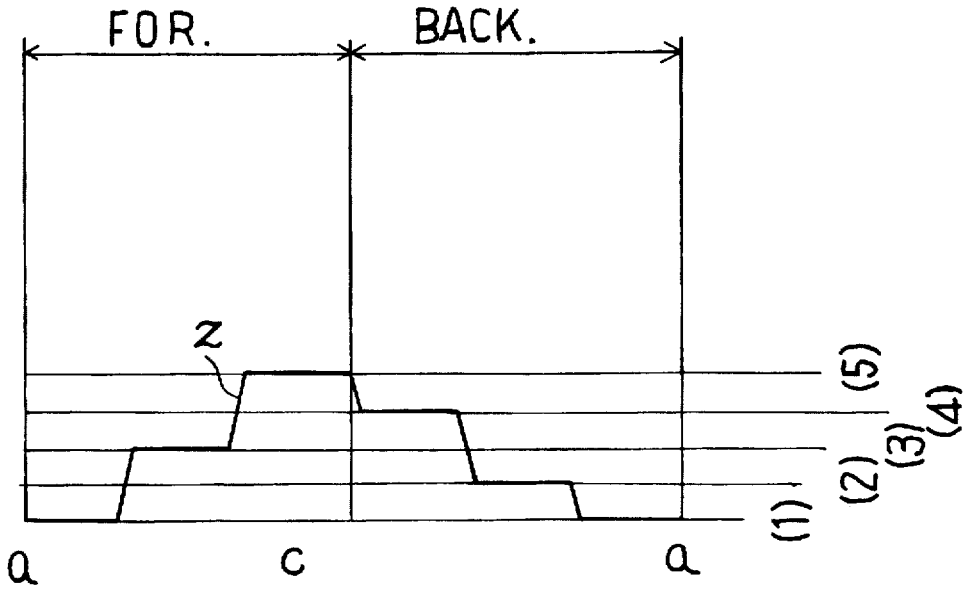
FIGS. 19 and 20 show cam surfaces in a further embodiment of the present invention.

Referring to FIG. 19, a further embodiment will be described, wherein the mechanical structures of the image forming apparatus are similar to those shown in FIGS. 3 and 4. In the present embodiment, the amount of movement by one shift is smaller than the reciprocable range. More particularly, the separating member is moved intermittently, and it separates the image carrying member at a stopped position, wherein the amount of movement by one shift may be small, by which the time required for the shifting movement can be reduced, but the stroke of the reciprocal range is preferably large from the standpoint of non-localization of the wear.

In consideration of the above, it is effective that the separating member is reciprocally moved by intermittent movement. In addition, the service life of the roller can be increased by changing the stopping positions of the separating pawl or pawls on the roller shaft between the forward movement of the reciprocable movement and the backward movement thereof.

Figure 20:
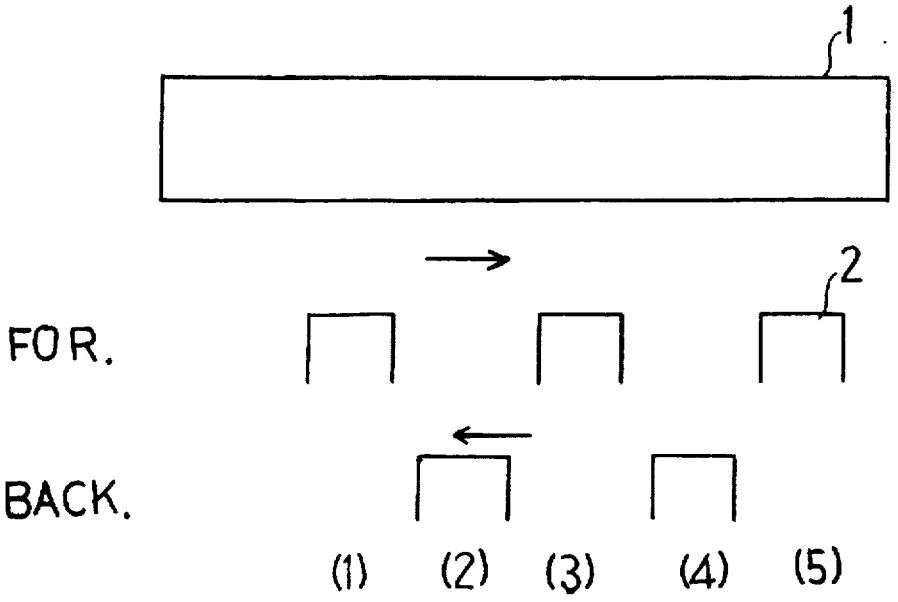

FIG. 19 is a developed view of a cam surface of the cam 23. The structures are the same as those shown in FIG. 9 in the other respect. The cam is provided with contact surfaces with the shaft 10 for the forward and backward movements, as indicated by (1), (2), (3), (4) and (5), wherein the cam surfaces (1), (2), (4) and (5) are for the forward movement of the cam, and the cam surfaces (1), (3) and (5) are for the backward movement, and wherein the cam surfaces (2) and (4) are different from the cam surface (3) in the pawl positioning and particularly in the contact width, as will be understood from FIG. 20.

In FIG. 19, an inclined cam surfaces Z are for guiding the end spherical portion of the shaft 30, and by the inclined surfaces Z the spherical portion is not stopped. The separating pawl is not stopped and kept contacted with the roller at the same position between when the pawl is moved forwardly and when the pawl is moved backwardly, and therefore, the service life of the roller is increased.

As for a method of changing the stop positions of the separating pawl between the forward movement and the backward movement, the total cam profile may be different between for the forward movement and for the backward movement, so that the amount of the intermittent shift may be made different.

In the structure of the image fixing apparatus shown in FIG. 11, the stop positions of the separating pawl may be made different during the forward movement than during the backward movement, in the manner described with the present embodiment. More particularly, the cam surfaces is so designed that the cam rotation for the one shift does not have an integer multiple of 360 degrees, by which the pawl is not stopped at the same position. The same effect can be provided by setting the angles so that the least common multiple is more than 360 degrees.

This embodiment is particularly effective with the embodiment of FIGS. 3 and 4 wherein the roller is disengaged and engaged in association with the shift of the separation pawl in the direction of the generating line of the roller.

In the embodiments shown in FIGS. 1, 2, 3 and 4, the edge 2*a* of the separation pawl 2 is normally contacted to the surface of the fixing roller, wherein the separation pawl is separated from the roller only when the solenoid is actuated, and therefore, even in the case that the solenoid can not pull the plunger for some reason or another such as failure in the solenoid or another electric system, the free edge 2*a* of the separation pawl 2 is contacted to the surface of the roller. Therefore, even if the copy sheet comes to the fixing apparatus with this state, the sheet is separated and is not wrapped around the roller. In the embodiments, a brake 25 is employed to prevent unintentional rotation of the cam. However, another means, such as a combination of the ratchet and a leaf spring for preventing rotation in one direction and an additional one-way clutch, may be used.

The description will be made as to the image forming apparatus of FIG. 7 which now incorporates the image fixing apparatus of this embodiment. When, in FIG. 7 apparatus, a sheet is jammed in the fixing apparatus, an unshown front cover or a discharging unit is opened for the clearance of the jam. In interrelation with this opening, the main switch is opened to stop the power supply to the image fixing apparatus at this time, the solenoid is assuredly deenergized, so that the contact of the separating member to the fixing roller is assured. Therefore, during the jam clearance operation, the separating function by the separating member can be maintained, and in addition, the possible damage to the roller surface by a sudden hit of the separation pawl to the roller can be prevented.

In this embodiment, a solenoid is used as for the means supplied with electric power, but the present invention is applicable to a mechanism wherein a member is contacted to another member where the first mentioned member is supplied with the power, but is disengaged therefrom when not supplied with power.

Figure 14:
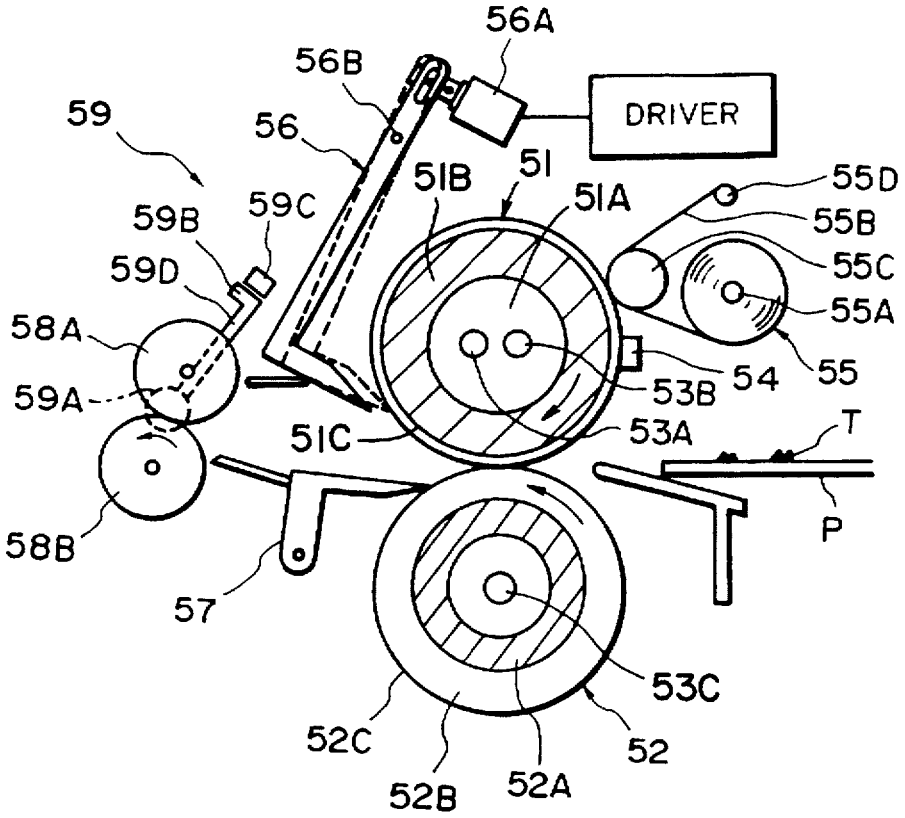
FIG. 14 is a side view of an image fixing apparatus according to a further embodiment of the present invention.

Referring to FIG. 14, a further embodiment will be described. In this Figure, an example of a heat fixing type image fixing apparatus is shown wherein an unfixed toner image T formed through an electrophotographic process on a recording material is fixed to a plain sheet of paper.

The fixing apparatus comprises a fixing roller containing therein heaters 53*a* and 53*b* in the form of a halogen heater or the like. The fixing roller 51 is driven by an unshown driving motor to rotate in a direction indicated by an arrow. The fixing apparatus further comprises a pressing or back-up roller 52 containing therein a low capacity heater 53C in the form of a sheath heater or the like and is rotated by the press contact with the fixing roller 51.

The fixing roller 51 includes a hollow core 51A of metal such as aluminum, copper and stainless steel, an elastic layer 51B, on the outer surface of the core metal, made of silicone rubber, fluorine rubber, fluorosilicone rubber, and having preferably a thickness of 0.065–0.75 mm, and preferably a coating layer 51C thereon made of PTFE or PFA resin having a thickness of 0.010–0.070 mm.

On the other hand, the pressing roller 52 includes a core 52A of metal, an elastic layer 52B, on the outer surface of the core metal 52A, made of silicone rubber, fluorine rubber, fluorosilicone rubber and EPDM, and having preferably a thickness of 2–10 mm, and preferably, a top surface or a coating tube 52C made of PTFE or PFA resin having a thickness of 0.010–0.100 mm.

To the outer surface of the fixing roller 51, a temperature sensing element 54 such as a thermister and a thermocouple, and the temperature signal by the temperature sensor 54 is introduced to a known control means (not shown), in response to which the heaters 53A and 53B are controlled so as to maintain the temperature of the outer periphery of the fixing roller 51 at a toner image fusing temperature.

An offset preventing liquid applying device 55 also functions as a cleaning means for removing foreign matter such as off-set toner or paper dust deposited on the surface of the fixing roller. The off-set preventing liquid applying device 55 includes a heat resistive web 55B wrapped around a supply roller 55A and made of NOMEX (trade name) or HIMERON (trade name) or the other. The web is impregnated with off-set preventing liquid such as dimethylsilicone oil, methylphenylsilicone oil, fluorosilicone oil and amino-modified silicone oil.

The cleaning web 55B is contacted to the fixing roller by an urging roller 55C having a resiliency.

The web 55B is pulled by a take-up roller 55D receiving a rotational driving force, so that the web 55B is advanced by a small amount to provide always a fresh surface of the web to be contacted to the fixing roller.

Separating members (pawls) 56 and 57 are contacted to the fixing roller and the pressing roller and function to assure separation of the recording medium (copy sheet) after the image fixation from the fixing roller 51 and the pressing roller 52. A plurality of such separation rollers are arranged along the longitudinal direction of the roller. The separation pawl 56 for the fixing roller is pivotable about a pivot 56B by the energization and deenergization of the solenoid 56A to be engaged to or disengaged from the surface of the fixing roller.

The copy sheet P after the image fixation is discharged outside the apparatus by the nip formed between discharging rollers 58A and 58B disposed at downstream of the pair of fixing rollers with respect to movement of the copy sheet P. The distance between the pair of discharging rollers 58A and 58B and a pair of fixing rollers 51 and 52, is selected to be substantially equal to the minimum length of various recording medium, for example, equal to the length of a post card (length of A6 size). The peripheral speed of the discharging rollers may be, theoretically, equal to the peripheral speed of the fixing rollers, but actually, it is preferably higher than the speeds of the discharging rollers so as to prevent the recording medium from wrapping around the fixing roller due to slackness of the recording medium.

In the sheet discharging section, there is provided a jam detection means 59 as a separating means. The detecting means 59 includes a roller 59A, an actuator 59B and a photointerruptor 59C. In the discharging section, when the copy sheet is received by the nip between the discharging rollers 58A and 58B, the roller 59A rotates in the clockwise direction about a pivot 59D, wherein an end portion of the actuator 59B remote from the roller intercepts the photointerruptor 59C. In the jam detecting means 59, when the copy sheet passes between the rollers 59A resets to a lower position by its weight, so that the interception of the photointerruptor 59C by the actuator 59B is stopped. In the case that the photointerruptor 59C is not intercepted within a predetermined period of time after production of the copy signal, it is discriminated that the copy sheet does not reach the discharge section, and therefore, a jam signal is produced. Also, in the case that the interception is not stopped within a predetermined period of time after the interception of the photointerruptor 59C, a jam signal is produced.

This embodiment will be described in further detail. The fixing roller 51 has a hollow core 51A of aluminum, a vulcanized silicone rubber layer 51B (elastic layer) having a thickness of 0.25 mm and a PTFE coating 51C thereon having a thickness of 20 microns. The outside diameter of the fixing roller 51 was 60 mm. The pressing roller 52 had a steel core 52A, a vulcanized silicone rubber layer 52B having a thickness of 5 mm, a fluorine rubber RATEX coating 52C having a thickness of 20 microns. The outside diameter of the pressing roller 52 was 60 mm. Copy sheets were processed at an image fixing speed (peripheral speed) of 480 mm/sec, that is, a copy speed of 80 sheets/min (A4 size).

The temperature of fixing roller was maintained at 180° C.

Figure 15:
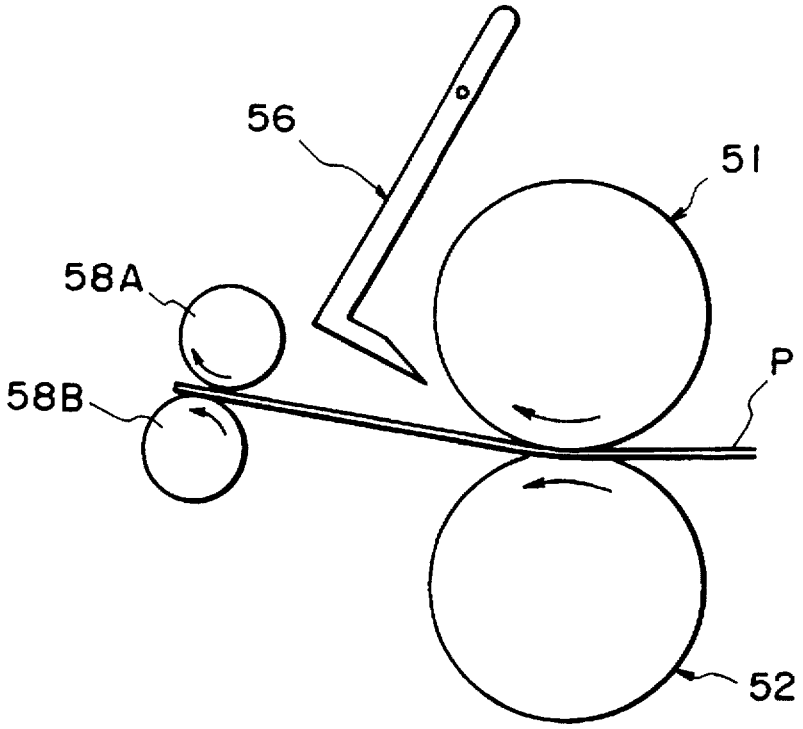
FIG. 15 illustrates separation timing of a separation member according to an embodiment of the present invention.

As shown in FIG. 15, the solenoid 56A was energized during the period from the nip between the discharging rollers 58A and 58B receiving the copy sheet P to the trailing edge of the copy sheet passing through the nip of the pair of fixing rollers 51 and 52. That is, the separation pawl 56 was spaced apart from the fixing roller during this period. This operation can be accomplished using a jam detection means 59, for example. More particularly, when the leading of the copy sheet after the image fixation was caught by the nip between the discharging rollers 58A and 58B, and the copy sheet pushed up the roller 59A to make the actuator 59B intercept the photointerruptor 59C, the solenoid 56A is energized to displace the separating pawl 56 away from the fixing roller 51. Thereafter, the trailing edge of the copy sheet passed through the nip between the discharging rollers 58A and 58B, the roller 59A fallen to stop the interception of the photointerruptor 59C. In response to the signal indicative of this event, the solenoid 56A was deenergized, and the separation pawl 56 was brought into contact with the fixing roller.

Under the above described conditions, 300,000 sheets were processed without any cleaning of the pair of fixing rollers and the separation pawls or the like, but there was no problem observed.

After the 300,000 sheets processed, the wear of the surface of the fixing rollers was not significant, and the further process was possible. The percentage of the jam occurrences at the image fixing station was 0.002%, which is a good result. In this embodiment, the solenoid 56A actuation signal was given from the jam detection member in the sheet discharging station. However, this is not limiting, and alternatively, the solenoid may be controlled by a microcomputer, for example, to be energized after a predetermined number of clockpulses are counted from a copy instruction signal.

COMPARISON EXAMPLE 1

The image fixing operations were performed under the same conditions as those described above with exception that the separation pawl 56 was always maintained in contact with the fixing roller 1. After about 150,000 sheets were processed, sheet jam became frequent, and therefore, the test run was stopped. The fixing roller 51 and the separation pawl 56 were remarkably worn, the toner was remarkably fused to the separation pawl 56. It was considered that the apparatus had reached the end of its service life. The percentage of the jam occurrences during the operation before the start of the frequent jam occurrences was 0.03% which was 15 times the jam percentage of the embodiment of the present invention.

COMPARISON EXAMPLE 2

The image fixing process operations were performed under the same conditions as the above described with the embodiment of the present invention with the exception that the disengagement and engagement of the separation pawl 56 were performed under the following conditions:

The separation pawl was separated after the leading edge of the copy sheet passed by the separation pawl and before it reached the pair of discharging rollers.

After about 100,000 sheets were processed, the copy sheets were wrapped with the result of jam occurrence, and the fixing roller was damaged, and therefore, the test run was stopped. The percentage of the jam occurrence before that was 0.05% which is significantly high. Many of this type of jam occurred wherein the copy sheet was wrapped around the fixing roller from the middle of the copy sheet.

Next, the description will be made as to the results of test runs of the fixing apparatus shown in FIGS. 3 and 4 disposed upstream of the discharging rollers.

The structure and material of the fixing rollers and the copy speed or other conditions were the same as the conditions with the embodiment of FIG. 14. The disengagement, engagement and longitudinal shift of the separation pawl were as follows. Similarly to the above described, the solenoid 18 was kept energized during the time from the copy sheet P being nipped by the discharging roller pair to the trailing edge of the copy sheet P passing through the fixing roller pair. That is, the separation pawl 2 was spaced apart from the fixing roller during this period. The cam profile was such that the separation pawl 2 was shifted through 0.1 mm in the longitudinal direction and was contacted again to the fixing roller after the solenoid 18 was deenergized immediately after the passage of the copy sheet. The amount of shift in the longitudinal direction was approximately three times the width of the separation pawl.

The results were that after 1,000,000 sheets were processed without cleaning of the fixing roller couple, the separation pawl or the like, there occurred no problem. The surface of the fixing roller after the 1,000,000 sheets were processed, showed some wear but further operation it was possible. The percentage of the jam occurrences in the fixing station was 0.0022% which is equivalent to the case of FIG. 14 embodiment.

Figure 16:
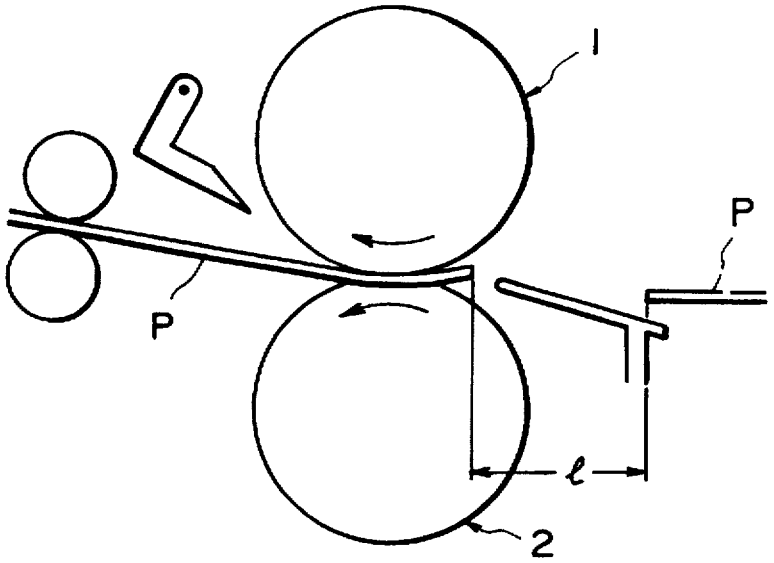
FIG. 16 illustrates separation timing of a separation member according to a further embodiment of the present invention.

The actual example of the further embodiment will be described. The image fixing process operations were performed under the same conditions as the above described in connection with the image fixing apparatus shown in FIGS. 3 and 4 with the exception that the disengagement and engagement timing of the separation pawl was changed. The timing was the same as described above in connection with the apparatus of FIGS. 3 and 4, whereas during a continuous copying mode, the following operation was performed once for each 50 sheets fixation, in the following manner. As shown in FIG. 16, while the trailing edge of the copy sheet is present in the nip of the fixing roller pair, the solenoid 18 was actuated to separate the separation pawl from the fixing roller, and immediately before the leading edge of the next copy sheet reached to the nip, the separation pawl was brought into contact with the fixing roller.

This is particularly advantageous in a high speed copying machine or a printer wherein the intervals between sheets are small, because it takes a certain time from the production of the signal for the above operation for the mechanism to complete it.

After 1,000,000 sheets were processed, the results were substantially the same as the results of the above example.

In this structure, the wear of the fixing roller by the separation pawl is mainly produced in the transient state at the occasions of the roller rotation starts and stops, in which an acceleration is produced due to the change from the static friction to the dynamic friction, and therefore, the degree of wear during the continuous copy is smaller than that during the intermittent copy.

In an apparatus wherein the fixing roller is rotated for a predetermined period of time within a period after the power switch actuated and before the preparatory operation completed, the separation pawl is preferably disengaged from the fixing roller during the preparatory operation period.

A further stabilized operation is possible, if the separation pawl is disengaged from the fixing roller by actuating the solenoid simultaneously with the copy instruction signal and keeping it energized for a predetermined period of time which is smaller than the period of time required for the copy sheet to reach the fixing station.

Figure 17:
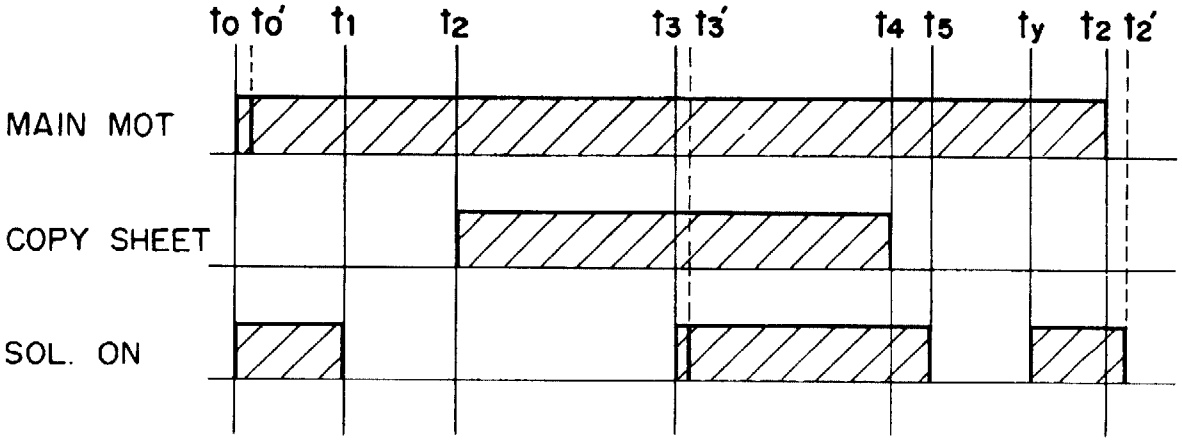
FIGS. 17 and 18 is a timing chart illustrating contact and separation timing of the separation member according to further embodiments of the present invention.
Figure 18:
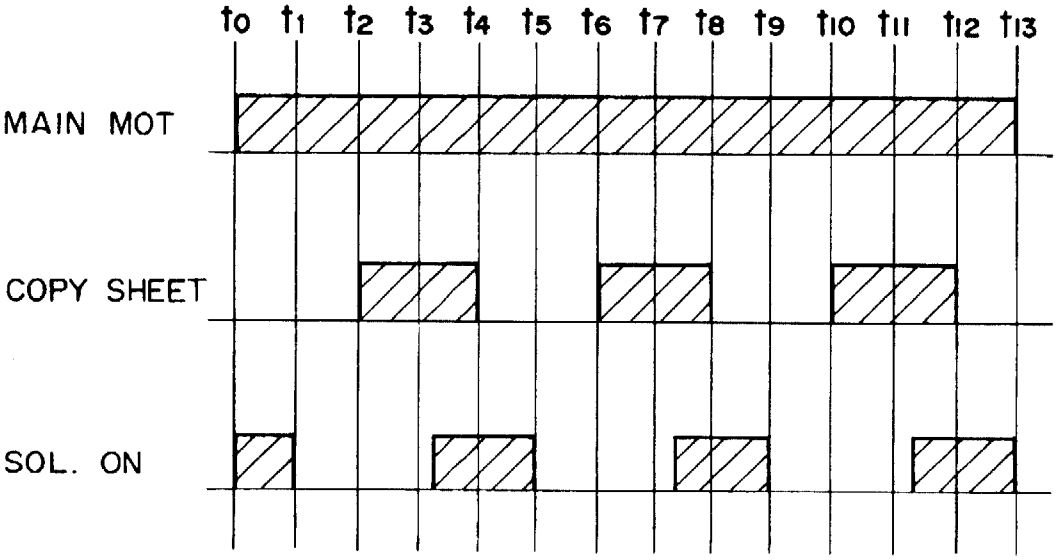

Referring to FIGS. 17 and 18, a yet further embodiment of the present invention will be described, wherein the structures of the image fixing apparatus is the same as those shown in FIG. 14. FIGS. 17 and 18 show sequential operations of this embodiment, wherein the operations of the main motor, the passage of the copy sheet through the fixing station and the operations of the solenoid are shown in a time chart. Energization of the main motor, passage of the copy sheet through the nip of the fixing roller pair and the energization of the solenoid are indicated by hatching lines. FIG. 17 represents a single copy, and FIG. 18 represents continuous plural copy operations. Various time periods indicated by "t" plus subscript are as follows:

to: copy start $t_1$, $t_5$, $t_9$, $t_{13}$: deenergization of the solenoid (separation pawl contacted to the fixing roller)

$t_2$, $t_6$, $t_{10}$: arrival of the leading edge of the copy sheet to the nip of the fixing roller pair $t_3$, $t_7$, $t_{11}$: arrival of the leading edge of the copy sheet to the nip of the discharging roller pair $t_4$, $t_8$, $t_{12}$: arrival of the trailing edge of the copy sheet to the nip of the fixing roller pair tz: end of copy operation (the actuation of the main motor)

In this Figure, $t_0'$ corresponding to $t_0$ indicative of the actuation of the main motor, and $t_3'$ corresponding to $t_3$ indicative of the actuation of the solenoid show preferable times, and either will do. $t_z'$ indicates that the solenoid is deenergized with a slide delay from $t_z$ at the time of the copy operation ending. With those conditions, 300,000 sheets were processed without cleaning of the fixing roller pair and the separation pawl or the like, and there was no problem observed. The good results are due to the disengagement and the engagement operations of the separating pawl at proper times. If the separation pawl is disengaged from and engaged with a heating time roller, and the period of disengagement is long, the toner deposited on the separation pawl is solidified during the disengagement period, and the separation pawl can damage the surface of the fixing roller at the time of the subsequent contact. The degree of the wear of the surface of the fixing roller after 300,000 sheets were processed was so in significant that further processing was possible. The percentage of the jam occurrences at the fixing station was 0.002% which meant good results. In this embodiment, the actuation signal for the solenoid was taken from the jam detecting member in the discharging station, but this is not limiting. As an example, the solenoid may be controlled by a microcomputer so that it is actuated after a predetermined number of clockpulses are counted from a copy instruction signal.

As described, by selecting the continuously separated period of the separation pawl which is small enough to prevent solidification of the toner, and therefore, the durability of the roller is improved. More particularly, the good results were obtained by setting the continuous separation period smaller than 3 seconds. Comparison Examples relative to this embodiment will be described.

COMPARISON EXAMPLE 1

The sheet were processed under the same conditions as described above in connection with FIG. 14 embodiment with the exception that the separation pawl 2 was kept contacted always with the fixing roller 1. The results were that the jam occurred frequently after approximately 100,000 sheets were processed, and therefore, the test runs were stopped. After the stoppage, the fixing roller 51 and the separation pawl 56 were significantly worn, and the toner fusing onto the separation pawl was remarkable. The apparatus was no longer considered usable. The percentage of the jam occurrence before the start of the frequent jam occurrence was 0.03% which was 15 times that of the embodiment of the present invention.

COMPARISON EXAMPLE 2

The copy sheets were processed under the same conditions as those described above in connection with the fixing apparatus of FIG. 14 with the exception that the disengagement and the engagement were performed under the following conditions. In order to keep the separation pawl separated from the fixing roller in as long period as possible except when the leading edges of the copy sheets reached the neighborhood of the separation pawl, the separation pawl was separated from the fixing roller during the stand-by period of the copying operation; and the separation pawl was brought into contact with the roller 0.2 sec before arrival of the copy sheet to the separation pawl, and the separation pawl was disengaged therefrom immediately after the leading edge of the copy sheet was separated.

After about 60,000 sheets were processed, the surface of the roller was damaged and the percentage of the jam was abruptly increased. It is considered that because the separation pawl was kept spaced from the fixing roller for more than 3 seconds, the toner fused to the separation pawl was solidified, and the solidified toner damaged it by the subsequent contact to the fixing roller. The structure for making the separating period shorter than the period required for the toner fused to the separation pawl to be solidified may be applied to the embodiment of FIGS. 3 and 4 with very advantageous results.

When, in the embodiment of FIGS. 3 and 4, the continuous separation period of the separation pawl 2 is made smaller than 3 sec, 1,000,000 sheets were processed without cleaning of the fixing roller pair and the separation pawl or the like, there was no problem. After 1,000,000 sheets were processed, the surface of the fixing roller was slightly worn, but it was still possible to further process the sheets. The percentage of the jam occurrences in the fixing station was 0.0022% which is a very good result. In the embodiments, the member shifted was the separation pawl, but the present invention is applicable to the other elements contacted to the surface of the fixing roller, such as the temperature detecting element, for example, thermister or the like.

In the foregoing embodiments, the amount of one shift is preferably longer than the width of the separation member or pawl, measure in the direction of the shift.

While the invention has been described with reference to the structures disclosed herein, it is not confined to the details set forth and this application is intended to cover such modifications or changes as may come within the purposes of the improvements or the scope of the following claims.

What is claimed is:

1. A mechanism for moving a member contactable to a rotatable member, comprising:

a contactable member contactable to said rotatable member;

reciprocating means for reciprocating, by plural intermittent motions, said contactable member in a direction of a generating line of the rotatable member, wherein said reciprocating means includes a single cam which reciprocates the contactable member and allows said contactable member to stop at different positions during a forward stroke than during a backward stroke by its one full turn.

2. A mechanism according to claim 1, wherein the rotatable member is an image fixing rotatable member for fixing an unfixed toner image, and wherein said contactable member is for separating an image carrying material carrying a fixed image from the rotatable member.

3. A mechanism according to claim 2, wherein the rotatable member is heated by a heating source for fusing an unfixed toner image.

4. A mechanism according to claim 1, wherein an amount of one of the intermittent motions is different for a forward movement stroke than for a backward movement stroke.

5. A mechanism according to claim 1, wherein said cam rotates through a predetermined angle being less than 360° in one intermittent motion, and any integer multiple of the predetermined angle being unequal to 360 degrees.

6. A mechanism according to claim 1, wherein the reciprocal movement of said contactable member is into and out of engagement with the rotatable member.

7. A mechanism according to claim 6, wherein said contactable member is shifted in the direction of the generating line after it is separated from the rotatable member.

8. A mechanism according to claim 7, wherein said contactable member engages the rotatable member after being shifted in the direction of the generating line.

9. A mechanism according to claim 6, wherein movement of said contactable member is carried out when a temperature of said rotatable member is higher than a toner fusing temperature.

10. A mechanism for separating a material from a rotatable member, comprising:

a separation member contactable to the rotatable member; and disengaging and engaging means for engaging and disengaging said separation member from and to the rotatable member, wherein said disengaging and engaging means is operated in response to electric power supply and shut-off thereof;

wherein said disengaging and engaging means brings said separation member into contact with the rotatable member when it is not supplied with the electric power, wherein said disengaging and engaging means includes a solenoid, and wherein said separation member contacts the rotatable member when the solenoid is not energized.

11. A mechanism according to claim 10, wherein the rotatable member functions to fix a toner image by contact thereof with the toner image.

12. A mechanism apparatus according to claim 11, wherein the rotatable member is incorporated in an image forming apparatus which comprises a portion that is openable, and wherein power supply to said disengaging and engaging means is shut-off in response to opening of the openable portion.

13. A mechanism according to claim 11, further comprising an openable portion, wherein a main power supply to the image forming apparatus is shut off in response to opening of the openable portion.

14. A mechanism according to claim 11, wherein the rotatable member is heated by a heating source for fusing an unfixed toner image.

15. An image fixing apparatus, comprising:

an image fixing rotatable member for fusing an unfixed toner image on an image carrying member, said image fixing rotatable member being heated by a heating source;

a separation member, contactable to said image fixing rotatable member, for separating the image carrying member from said image fixing rotatable member; and disengaging and engaging means for disengaging and engaging said separation member from and to said image fixing rotatable member;

wherein said disengaging and engaging means maintains separation between said separation member and said image fixing rotatable member for a time period which is shorter than a time period required for fused toner deposited on a leading portion of said separation member to solidify.

16. An apparatus according to claim 15, wherein a plurality of said separation members are provided and further comprising a supporting member for supporting said plural separation members, and wherein said separation members are moved by moving said supporting member.

17. An apparatus according to claim 16, wherein said plurality of separation members are distributed according to sizes of image carrying members usable with said apparatus.

18. An apparatus according to claim 17, wherein movement of said separation members is carried out when a temperature of said rotatable member is higher than a toner fusing temperature.

19. An image forming apparatus comprising:

an image forming means for forming an unfixed image on an image carrying member;

an image fixing rotatable member for fixing the unfixed image on the image carrying member;

a member contactable to said image fixing rotatable member; and moving means for moving said contactable member in a direction of a generating line of said image fixing rotatable member for each of a predetermined number of image carrying members having unfixed images;

wherein said image fixing rotatable member fixes unfixed images on the number of image carrying members which number is instructed by printing instructions and said image fixing rotatable member continues to rotate while it fixes the unfixed images on the instructed number of image carrying members;

wherein the predetermined number of image carrying members increases with the number instructed by the printing instructions.

20. An apparatus according to claim 19, wherein said contactable member moves into and out of engagement with said image fixing rotatable member.

21. An apparatus according to claim 19, wherein said moving means is a supporting member for supporting said contactable member.

22. An apparatus according to claim 21, wherein a plurality of such contactable members are provided and are supported by said supporting member, which is moved to shift said contactable members.

23. An apparatus according to claim 22, wherein said plurality of contactable members are distributed according to sizes of image carrying materials usable with said apparatus.

24. An apparatus according to claim 21, wherein movement of said contactable member is carried out when a temperature of said rotatable member is higher than a toner fusing temperature.

25. An apparatus according to claim 19, wherein said rotatable member is heated by a heating source for fusing an unfixed toner image.

26. An image fixing apparatus, comprising:

an image fixing rotatable member for fixing an image;

a separation member, contactable with said image fixing rotatable member, for separating an image carrying member carrying a fixed image from said image fixing rotatable member;

moving means for moving said separation member in a direction of a generating line of said image fixing rotatable member and for disengaging and engaging said separation member from and to said image fixing rotatable member;

a pair of rotatable members disposed downstream of said image fixing rotatable member with respect to a movement direction of the image carrying member, wherein the image carrying member, after being separated from said image fixing rotatable member, is received by said pair of rotatable members, and wherein said moving means disengages said separation member from said image fixing rotatable member after said image carrying member is received by said pair of rotatable members and is in a nip formed between said pair of rotatable members.

27. An apparatus according to claim 26, wherein said pair of rotatable members functions to discharge the image carrying member outside of said apparatus.

28. An apparatus according to claim 26, wherein said image fixing rotatable member is heated by a heating source for fusing an unfixed toner image.

29. An apparatus according to claim 26, wherein a plurality of such separating members are provided and are supported by a supporting member, which is moved to shift said separating members.

30. An apparatus according to claim 29, wherein said plurality of separating members are distributed according to sizes of image carrying members usable with said apparatus.

31. An apparatus according to claim 27, wherein said image fixing rotatable member is press-contacted to a back-up roller to form a nip therebetween, and when said image carrying member is in the nip, said disengaging and engaging means disengages said separating member from said image fixing rotatable member.

32. A mechanism according to claim 13, 27, or 31, wherein movement of said separation member is carried out when a temperature of said rotatable member is higher than a toner fusing temperature.

* * * * *

UNITED STATES PATENT AND TRADEMARK OFFICE

CERTIFICATE OF CORRECTION

PATENT NO. : 5,802,434

DATED : September 1, 1998

INVENTORS : YOSHIFUMI TAKEHARA, ET AL.

It is certified that error appears in the above-identified patent and that said Letters Patent is hereby corrected as shown below:

On the title page,

Item [56],
Line 1 , "Slucha," should read -- Szlucha ,--

COLUMN 1,
Line 30, "phenomena" should read --phenomenon--.

COLUMN 3,
Line 63, "rotalably" should read --rotatably--.

COLUMN 7,
Line 41, "with," should read --with--.

COLUMN 9,
Line 46, "continued" should read --continues--.

COLUMN 12,
Line 1, "applicable the" should read --applicable to the--; and
Line 42, "an" should be deleted.

COLUMN 13,
Line 43, "roller" should read --roller 51--.

UNITED STATES PATENT AND TRADEMARK OFFICE

CERTIFICATE OF CORRECTION

PATENT NO. : 5,802,434

DATED : September 1, 1998

INVENTORS : YOSHIFUMI TAKEHARA, ET AL.

It is certified that error appears in the above-identified patent and that said Letters Patent is hereby corrected as shown below:

COLUMN 15,
Line 52, "with exception" should read --with the exception--.

COLUMN 16,
Line 37, "it was" should read --was--.

COLUMN 17,
Line 7, "actuated" should read --is actuated--;
Line 8, "completed," should read --is completed,--;
Line 30, "to:" should read --$t_o$:--;
Line 40, "tz:" should read --$t_z$:--; and
Line 59, "in significant" should read --insignificant--.

COLUMN 18,
Line 9, "sheet" should read --sheets--.

UNITED STATES PATENT AND TRADEMARK OFFICE

CERTIFICATE OF CORRECTION

PATENT NO. : 5,802,434

DATED : September 1, 1998

INVENTORS : YOSHIFUMI TAKEHARA, ET AL.

It is certified that error appears in the above-identified patent and that said Letters Patent is hereby corrected as shown below:

COLUMN 19,
Line 65, "apparatus" should be deleted.

COLUMN 22,
Line 27, "27, or 31," should be deleted--.

Signed and Sealed this

Fifteenth Day of June, 1999

*Attest:*

Q. TODD DICKINSON

*Attesting Officer*

*Acting Commissioner of Patents and Trademarks*